US005707716A

United States Patent [19]

Yoshino et al.

[11] Patent Number: 5,707,716

[45] Date of Patent: Jan. 13, 1998

[54] RECORDING MEDIUM

[75] Inventors: Hitoshi Yoshino, Zama; Kyo Miura, Yokohama; Takeo Eguchi, Tokyo, all of Japan

[73] Assignee: Canon Kabushiki Kaisha, Tokyo, Japan

[21] Appl. No.: 547,464

[22] Filed: Oct. 24, 1995

[30] Foreign Application Priority Data

| | | | |
|---|---|---|---|
| Oct. 26, 1994 | [JP] | Japan | 6-262598 |
| Aug. 3, 1995 | [JP] | Japan | 7-198647 |
| Oct. 13, 1995 | [JP] | Japan | 7-265464 |

[51] Int. Cl.[6] ..... B41J 2/01

[52] U.S. Cl. ..... 428/212; 428/195; 428/206; 428/304.4; 428/329; 428/409; 428/537.5

[58] Field of Search ..... 428/195, 207, 428/211, 329, 537.5, 206, 212, 304.4, 323, 409

[56] References Cited

U.S. PATENT DOCUMENTS

| | | | |
|---|---|---|---|
| 4,202,870 | 5/1980 | Weber et al. | 423/630 |
| 4,242,271 | 12/1980 | Weber et al. | 260/448 AD |
| 4,879,166 | 11/1989 | Misuda et al. | 428/212 |
| 5,104,730 | 4/1992 | Misuda et al. | 428/304.4 |

FOREIGN PATENT DOCUMENTS

| | | |
|---|---|---|
| 51-38298 | 3/1976 | Japan . |
| 54-59936 | 5/1979 | Japan . |
| 55-5830 | 1/1980 | Japan . |
| 55-51583 | 4/1980 | Japan . |
| 56-120508 | 9/1981 | Japan . |
| 58-110288 | 6/1983 | Japan . |
| 59-3020 | 1/1984 | Japan . |
| 2-276670 | 11/1990 | Japan . |
| 4-202011 | 7/1992 | Japan . |
| 4-267180 | 9/1992 | Japan . |
| 5-16517 | 1/1993 | Japan . |
| 5-32413 | 2/1993 | Japan . |
| 5-32414 | 2/1993 | Japan . |
| 5-16015 | 3/1993 | Japan . |
| 6-114669 | 4/1994 | Japan . |
| 6-114670 | 4/1994 | Japan . |
| 6-114671 | 4/1994 | Japan . |

OTHER PUBLICATIONS

"An Explanation of Hysteresis in the Hydration and Dehydration of Gels", McBain, The Journal of the American Chemical Society, vol. LVII, Apr., 1935, pp. 699–700.

"Adsorption of Gases in Multimolecular Layers", Brunauer, et al., The Journal of the American Chemical Society, vol. LX, Feb., 1938, pp. 309–319.

Journal of Japan Institute of Light Metals, vol. 22, No. 4, pp. 295–307, Apr. 1972.

"Crystal Chemistry of Boehmite", Tettenhorst, et al., Clays and Clay Minerals, Journal of the Clay Minerals Society, vol. 28, No. 5, 1980, pp. 373–380.

Patent Abstracts of Japan, vol. 17, No. 321 (C–1072) with respect to JP–A–05 032414 (Jun. 18, 1993).

Patent Abstracts of Japan, vol. 17, No. 321 (C–1072) with respect to JP–A–05 032413 (Jun. 18, 1993).

"The Determination of Pore Volume and Area Distributions in Porous Substances. I. Computation from Nitrogen Isotherms", Barrett, et al., The Journal of the American Chemical Society, vol. LXXIII, Jan., 1951, pp. 373–380.

"Porous Structure of Aluminum Hydroxide and its Content of Pseudoboehmite", Rocek, et al., Applied Catalysis, vol. 74, Elsevier Science Publishers, Amsterdam, 1991, pp. 29–36.

*Primary Examiner*—Pamela R. Schwartz

*Attorney, Agent, or Firm*—Fitzpatrick, Cella, Harper & Scinto

[57] ABSTRACT

A recording medium is provided which is constituted of a base material and an ink-receiving layer formed on the base material and containing alumina hydrate of a boehmite structure, or is constituted of a fibrous material and alumina hydrate of a boehmite structure incorporated therein. The alumina hydrate in the ink-receiving layer or the fibrous material has an interplanar spacing of (020) plane of exceeding 0.617 nm but not more than 0.620 nm, and crystallite size in a direction perpendicular to (010) plane ranging from 6.0 to 10.0 nm.

20 Claims, 1 Drawing Sheet

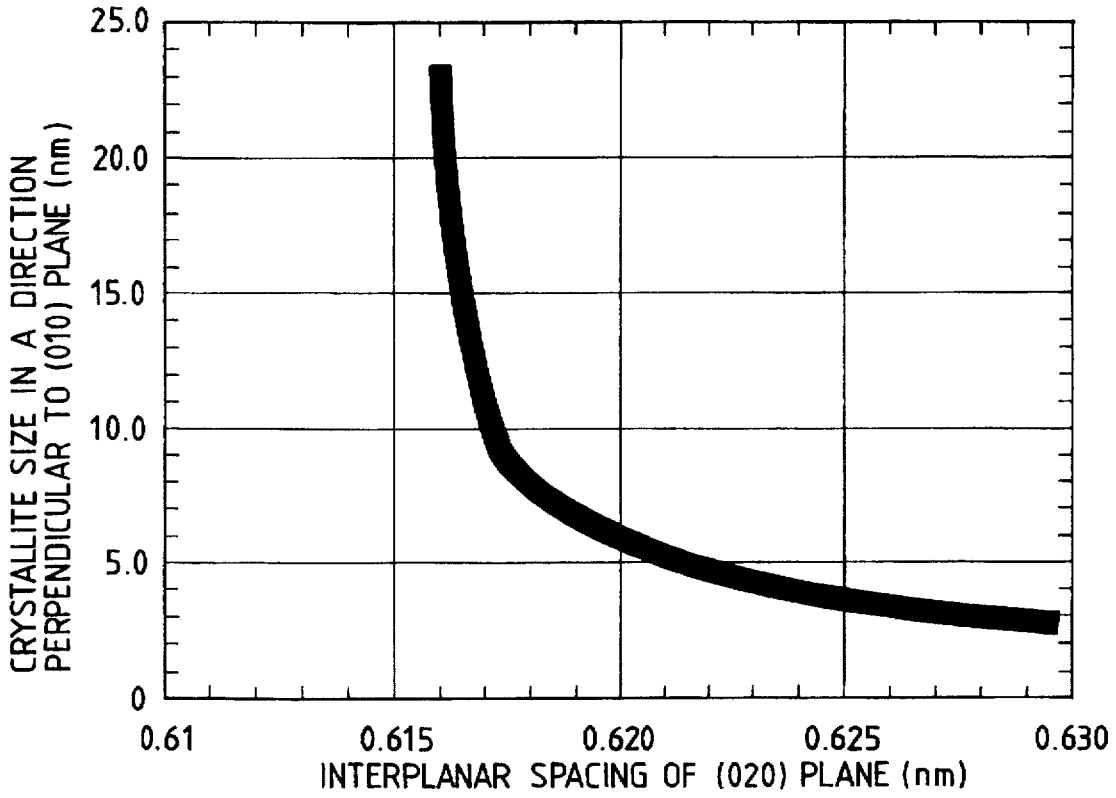
25.0
20.0
15.0
10.0
5.0
0
CRYSTALLITE SIZE IN A DIRECTION PERPENDICULAR TO (010) PLANE (nm)
0.61
0.615
0.620
0.625
0.630
INTERPLANAR SPACING OF (020) PLANE (nm)

RECORDING MEDIUM

BACKGROUND OF THE INVENTION

1. Field of the Invention

The present invention relates to a recording medium suitable for recording with an ink, a process for production of the recording medium, and an image-forming method employing the recording medium. Particularly, the present invention relates to an ink-jet recording medium which is capable of forming images with high image density and clear color tone, and has high ink absorbency, to a process for production of the recording medium, and to an image-forming method employing the recording medium.

2. Related Background Art

The ink-jet recording is a method for recording images and letters by ejecting fine droplets of ink onto a recording medium such as a paper sheet. The ink-jet recording is becoming popular rapidly in recent years in various applications because of its high recording speed, low noise generation, ease of multicolor recording, flexibility in pattern recording, and needlessness of image development and fixation. Multicolor ink-jet recording is coming to be used in full color image recording since it is capable of giving images comparable with images formed by multicolor gravure printing or color photography, and is less expensive than multicolor printing when the number of reproduction is small.

With improvements of the ink-jet recording apparatus and method in recording speed, fineness of recording, and full color recording, the recording medium is also required to have higher qualities. Hitherto, various types of recording media have been disclosed to meet the requirements. For example, JP-A-55-5830 ("JP-A" herein means Japanese Patent Laid-Open Publication) discloses an ink jet recording paper sheet which has an ink-absorbing coating layer provided on a supporting paper sheet; and JP-A-55-51583 discloses use of noncrystal silica as a pigment in a coating layer. U.S. Pat. Nos. 4,879,166, 5,104,730, JP-A-2-276670, JP-A-5-32413, and JP-A-5-32414 disclose recording sheets having an ink-receiving layer containing alumina hydrate of pseudo-boehmite structure.

Conventional recording media, however, have disadvantages as follows.

One disadvantage is that conventional recording media are insufficient in adsorption and coloring state of a dye contained in the ink, and do not give high optical density of printed areas. To offset the disadvantage, JP-A-5-32414 discloses a recording medium employing alumina sol having an interplanar spacing of (020) plane of not more than 6.17 Å (0.617 nm), and describes that a smaller interplanar spacing provides high optical density of printed areas. However, a smaller interplanar spacing of the alumina hydrate makes the surface thereof hydrophobic, which causes another disadvantage of low absorbency for the solvent component of the ink to result in low image quality owing to ink repulsion in the printed area, or to result, with a dye of high hydrophilicity, in low optical density, or bleeding or beading of ink dots. A smaller interplanar spacing brings also an disadvantage of low bonding strength of the alumina hydrate with a binder which is a hydrophilic resin to cause powder-falling or cracking of the ink-receiving layer.

Another disadvantage of conventional recording media is that the ink-receiving layer formed by using a porous material is not sufficiently transparent, causing white-turbidity or insufficient optical density of the printed area. To offset the disadvantage, JP-A-5-32413 and JP-A-5-32414 disclose a transparent low-haze alumina sol having a crystallite size of not less than 60 Å (6.0 nm), or not less than 70 Å (7.0 nm) in a direction perpendicular to (010) plane, and disclose also a recording medium employing the alumina sol. On the other hand, JP-A-59-3020 and a report in "Keikinzoku" (Light Metal), Vol. 22, No. 4, pp. 295–308 show that the crystal structure of the alumina hydrate is changed by a heat treatment or a dispersion treatment. A report in "Clays and Clay Minerals", Vol. 28, No. 5, pp. 373–380 (1980) discloses that the crystal structure of the alumina hydrate is changed by drying conditions of the dispersion. Therefore, even when the alumina hydrate having a controlled interplanar spacing of (020) plane and a controlled crystallite size in a direction perpendicular to (010) plane is used for preparation of a recording medium, the interplanar spacing and the crystallite size are not always the same as those of the starting alumina hydrate or alumina sol in the formed recording medium produced through coating and drying steps after a coating dispersion has been prepared by adding a binder to the alumina hydrate. Therefore, the above-cited documents do not describe the method for obtaining a recording medium prepared through a series of steps from a dispersion of alumina hydrate, which has a controlled interplanar spacing of the alumina hydrate of (020) plane and the controlled crystallite size in a direction perpendicular to the (010) plane in the resulting recording medium.

A still another disadvantage of conventional recording media is that they have an insufficient transparency of the ink-receiving layer in an application to observe an image with transmitted light such as overhead projector (OHP) films and in obtaining a high optical density. U.S. Pat. No. 5,104,730 and JP-A-2-276670 disclose a recording medium having a porous ink-receiving layer which has a porous layer having a volume of pores with a pore radius exceeding 100 Å (10.0 nm) at not larger than 0.1 cc/g ($cm^3/g$), and having a low haze. However, the transparency of the ink-receiving layer is not improved by merely controlling the pore diameter and the pore volume, since the transparency is greatly affected by a crystallite size.

A further disadvantage of conventional recording media is that, in color image printing in which inks are applied in a larger amount onto a recording medium, the ink flows out, or the recorded image spreads to impair the image quality, or printed image density becomes low. To offset this disadvantage, JP-A-58-110288 and JP-A-2-267760 disclose a recording medium having a pore size distribution controlled to have peaks at a specified pore radius. This is based on the idea that ink absorbency, printed image density, and image resolution depend on the pore diameter distribution and the pore volume. This method, however, does not provide a sufficiently high density and a resolution of the image. This problem is not solved by merely controlling the pore diameter distribution and the pore volume without controlling the crystal structure.

SUMMARY OF THE INVENTION

The present invention intends to provide a recording medium which is adaptable to many kinds of inks, capable of giving high optical density of printed area, excellent in transparency, and less liable to give cracking, powder falling-off, and curling.

The present invention intends also to provide a process for producing the recording medium, and a method of image formation employing the recording medium.

The objects can be achieved by the present invention mentioned below.

The recording medium of the present invention contains alumina hydrate of a boehmite structure, in which an interplanar spacing of (020) plane of alumina hydrate is exceeding 0.617 nm but not more than 0.620 nm, and the crystallite size in a direction perpendicular to (010) plane is ranging from 6.0 to 10.0 nm.

The process of the present invention for the preparation of a recording medium containing alumina hydrate of a boehmite structure having an interplanar spacing of (020) plane of exceeding 0.617 nm but not more than 0.620 nm and the crystallite size in a direction perpendicular to (010) plane ranging from 6.0 to 10.0 nm comprises preparing an alumina hydrate dispersion by dispersing alumina hydrate of a boehmite structure having an interplanar spacing of (020) plane of exceeding 0.617 nm but not more than 0.620 nm; and applying the alumina hydrate dispersion onto a base material to form an ink-receiving layer, or incorporating the alumina hydrate dispersion into a fibrous material.

The process of another embodiment of the present invention for the preparation of a recording medium containing alumina hydrate of a boehmite structure having an interplanar spacing of (020) plane of exceeding 0.617 nm but not more than 0.620 nm as a whole, and the crystallite size in a direction perpendicular to (010) plane ranging from 6.0 to 10.0 nm comprises preparing an alumina hydrate dispersion by dispersing one or more kinds of alumina hydrate of a boehmite structure having an interplanar spacing of (020) plane of not more than 0.617 nm and other one or more kinds of alumina hydrate of a boehmite structure having an interplanar spacing of (020) plane of not less than 0.620 nm; and applying the alumina hydrate dispersion onto a base material to form an ink-receiving layer, or incorporating the alumina hydrate dispersion into a fibrous material.

The method of forming an image of the present invention conducts printing by ejecting ink droplets through a fine nozzle onto the above-described recording medium. The method of ejection of the ink droplets includes ink droplets ejection by applying thermal energy to the ink.

BRIEF DESCRIPTION OF THE DRAWINGS

FIGURE is a graph showing a relation between an interplanar spacing of (020) plane and a crystallite size in a direction perpendicular to (010) plane of alumina hydrate in the recording medium of the present invention.

DESCRIPTION OF THE PREFERRED EMBODIMENTS

The recording medium of the present invention is excellent in both an absorbency for ink solvent and a dye adsorption property, suitable for greater varieties of inks and dyes, less liable to cause cracking and excellent in water fastness, and gives printed dots in a uniform diameter.

The recording medium of the present invention is constituted of a base material, and an ink-receiving layer composed mainly of alumina hydrate of a boehmite structure and a binder formed on the base material, or constituted of a fibrous material into which alumina hydrate of a boehmite structure is incorporated.

The alumina hydrate, which is positively charged, is preferred as the constituting material for ink-receiving layer, since it fixes the applied ink by the positive charge to give excellent colors of images, and does not involve the disadvantages of browning of black ink and low light-fastness which are problems involved in use of a silica type compound for the ink-receiving layer.

Of the alumina hydrates, the one showing a boehmite structure in X-ray diffraction is more suitable because of a high dye-adsorption property, a high ink-absorbency, and a high transparency thereof.

The alumina hydrate is defined by the general formula $$Al_2O_{3-n}(OH)_{2n}\cdot mH_2O$$

where n is an integer of zero to 3, and m is a number of from zero to 10, preferably from zero to 5. Most part of the moiety "$mH_2O$" exists as free water which does not contribute to the construction of crystal lattice and is releasable. Therefore, the value of "m" is not necessarily an integer.

Generally, alumina hydrate of a boehmite structure is a layer-structured substance the (020) plane of which forms a huge plane and exhibits a characteristic diffraction peak in an X-ray diffraction pattern. The boehmite structure herein includes boehmite, and pseudo-boehmite which contain excess water between the (020) planes. The pseudo-boehmite exhibits peaks of X-ray diffraction pattern broader than that of boehmite. The boehmite and the pseudo-boehmite are not precisely distinct from each other. Therefore, in the present invention, the alumina hydrate of a boehmite structure includes both types of boehmite unless otherwise mentioned, and is referred to simply as alumina hydrate.

Upon measuring peaks of (020) plane which appears at a diffraction angle 2θ of from 14° to 15°, from the diffraction angle 2θ and the half width B of the peak, an interplanar spacing of (020) plane can be calculated according to Bragg's equation and a crystallite size in a direction perpendicular to (010) plane can be calculated according to Scherrer's equation.

An interplanar spacing of (020) plane can be used as a measure for the content of excess water enclosed between the layers of the alumina hydrate. Generally, the alumina hydrate having a smaller interplanar spacing is more hydrophobic owing to the lower content of excess water between the (020) plane layers, while the one having a larger interplanar spacing is more hydrophilic owing to the higher content of excess water between the (020) plane layers. An interplanar spacing of (020) plane of a single crystal of boehmite is about 0.611 nm, and that of pseudo-boehmite containing a large amount of excess water between the layers is in a range of from 0.63 to 0.66 nm.

The process for producing the alumina hydrate to be used in the present invention is not specially limited, provided that alumina hydrate of a boehmite structure can be produced thereby. The process includes hydrolysis of aluminum alkoxide, hydrolysis of sodium aluminate, and the like known process. Otherwise, as shown in JP-A-56-120508, amorphous alumina hydrate judged by X-ray diffraction can be converted by heat treatment at a temperature of 50° C. or higher in the presence of water to alumina hydrate of a boehmite structure.

A particularly preferred process is hydrolysis and peptization of long chain aluminum alkoxide by an acid into alumina hydrate. The long-chain alkoxide herein means alkoxides of 5 or more carbon atoms, more preferably alkoxides of 12 to 22 carbon atoms. It is preferable to use such an aluminum alkoxide for removal of the alcohol component and control of the shape of the alumina hydrate of a boehmite structure are facilitated as mentioned below.

The acid for the hydrolysis may be selected arbitrarily from organic acids and inorganic acids. Of the acids, nitric acid is preferred in view of efficiency of the hydrolysis reaction, ease of controlling the shape of the alumina hydrate, and dispersibility thereof. The particle size can be adjusted after the hydrolysis by hydrothermal synthesis. By the hydrothermal synthesis treatment of the alumina hydrate dispersion containing nitric acid, the water dispersibility of the alumina hydrate can be improved because a nitrate anion is fixed from the aqueous solution onto the surface of the alumina hydrate.

The process for the preparation of aluminum alkoxide by hydrolysis is advantageous because of less contamination by impurities like foreign ions in comparison with the process for the preparation of alumina hydrogel or cationic alumina. Further the use of long-chain aluminum alkoxide is advantageous in that the formed alcohol after the hydrolysis can be completely removed from the alumina hydrate in comparison with the case where a short chain alkoxide such as aluminum isopropoxide is used. The pH value of the solution at the start of the hydrolysis is preferably adjusted to be not higher than 6. At the pH of 8 or higher, the finally obtained alumina hydrate becomes crystalline.

The boehmite structure of the alumina hydrate depends on the production conditions such as the conditions of hydrolysis and peptization (apparatus, temperature, reaction time, and pH), the conditions of hydrothermal synthesis (apparatus, temperature, pressure, number of repetition, reaction time, and pH), drying conditions of the alumina hydrate dispersion (apparatus, temperature, and time), and so forth.

Generally, as temperatures at the steps of hydrolysis, peptization, hydrothermal synthesis, drying, etc. will be higher, and time of the steps will be longer, an interplanar spacing of (020) plane will become narrower. The boehmite structure can be changed by a post-treatment after the production. Heat treatment makes sharper the diffraction peak as shown in JP-A-59-3020. This results from elimination of excess water contained between the layers formed by the (020) planes. By a heat treatment at 120° C. for one hour or longer a nearly stable structure can be provided and a diffraction peak can become stable. On the other hand, violent dispersion treatment such as grinding makes the diffraction peak broader as shown in "Keikinzoku" (Light Metal), vol. 22, No. 4, pp. 295–308.

The alumina hydrate of a boehmite structure, generally, has a transition point at a temperature ranging from 160° C. to 250° C. Heating above the transition temperature causes change of the crystal structure to be crystalline, and is undesirable for maintaining the boehmite structure. Because the alumina hydrate useful for the recording medium has a thermal hysteresis in the production thereof in the boehmite structure such as an interplanar spacing and a crystallite size, a later heat treatment at a temperature lower than the highest temperature in the production process does not cause change of crystal structure like the boehmite structure. Therefore, the temperature in the heat treatment of the alumina hydrate and in the production of the recording medium is preferably lower than the transition temperature in order to retain the boehmite structure of the alumina hydrate in the recording medium.

The recording medium of the present invention can be prepared by forming an ink-receiving layer from alumina hydrate and a binder, or incorporating alumina hydrate into a fibrous material. As described above, the crystal structure of alumina hydrate in the recording medium depends not only on the starting alumina hydrate but also on the conditions of dispersing the alumina hydrate in a coating liquid and the conditions of heating for drying. Further, combined use of several kinds of alumina hydrates can change the entire crystal structure of alumina hydrate in a recording medium.

A crystal structure of alumina hydrate in a recording medium can be measured by a usual X-ray diffraction method. Specifically, an interplanar spacing of (020) plane and a crystallite size in a direction perpendicular to (010) plane can be calculated by measuring peaks of (020) plane which appears at a diffraction angle 2θ ranging from 14° to 15°, upon setting alumina hydrate, a recording medium having an ink-receiving layer containing alumina hydrate, or a recording medium incorporated with alumina hydrate, in an X-ray diffraction measurement cell.

The interplanar spacing of (020) plane of alumina hydrate in a recording medium of the present invention is preferably above 0.617 nm but not more than 0.620 nm. Within this range, a scope of dyes to be selected can be broader; an optical density of printed areas can be higher regardless of either hydrophobic or hydrophilic dyes; bleeding, beading, and repulsion of the ink can be made less to occur; the printed image can be made uniform in optical density; and the printed dots can be made uniform in dot diameter regardless of the kinds of dyes or even with combined use of a hydrophobic dye and a hydrophilic dye. Furthermore, within this range, even if the ink contains a hydrophilic material or a hydrophobic material, the optical density of the printed area and the dot diameter are uniform, and bleeding, beading and repulsion of the ink can be made less to occur. Occurrence of curling or tacking of the recording medium can also be prevented.

This is because the ratio of a hydrophobicity to a hydrophilicity of alumina hydrate in the recording medium is appropriate within the above range of the interplanar spacing of (020) plane. Accordingly, the adsorption of hydrophilic and hydrophobic dyes in an ink is sufficient, and the compatibility of solvent components in an ink is improved. Within the above range of the interplanar spacing of (020) plane, presumably, water is eliminated less from the alumina hydrate, thereby resulting in less curling of the recording medium during production thereof; and the amount of water entering and leaving the alumina hydrate is less, resulting in less occurrence of curling and tacking with lapse of time.

The term "bleeding" means spreading or broadening of the dye-colored area in comparison with the actually printed area when a certain area is solid-printed. The term "beading" means a phenomenon that a spot-like irregularity of optical density appears due to coalescence of ink droplets at a solid-print area. The term "repulsion" means a formation of non-colored portion in a solid-print area.

When the interplanar spacing of (020) plane of the alumina hydrate in the recording medium is less than 0.617 nm, certain kinds of dyes are adsorbed satisfactorily to give high optical density of a printed area as disclosed in JP-A-5-32414. With such alumina hydrate, however, hydrophilic dyes are liable to cause bleeding and beading. Further, such alumina hydrate has higher hydrophobicity of the surface, and therefore has lower ink wettability, thereby being liable to cause ink repulsion, or giving increased active catalytic points to cause discoloration of a printed area during storage.

When the interplanar spacing of (020) plane of the alumina hydrate in the recording medium is more than 0.620 nm, absorption of a solvent of an ink is improved, but the ink tends to bleed to decrease an optical density of a printed area. Because such alumina hydrate contains water in a larger amount between the layers thereof, an amount of water which is eliminated from the alumina hydrate becomes larger during a drying step, and therefore a recording medium tends to cause curling at the production thereof. Further, a higher water content of alumina hydrate tends to cause curling and tacking, and changes an ink-absorbency, an optical density of a printed area, and dot diameters during storage. Furthermore, a hydrophilicity of a surface of alumina hydrate tends to cause a dye-bleeding and an ink-beading, and to lower a water fastness of a printed image, when the dye is strongly hydrophobic.

The crystallite size of alumina hydrate in a direction perpendicular to (010) plane ranges preferably from 6.0 to 10.0 nm in the recording medium of the present invention. Within this range, the ink-receiving layer has a sufficient transparency, and the recording medium has a high ink absorbency, and a high dye-absorbing ability with less tendency of cracking and powder-falling.

With the crystallite size of less than 6.0 nm, bonding of the alumina hydrate to a binder or a fibrous material becomes weak, by which cracking and powder-falling are liable to occur, and dye adsorption ability is lowered to cause lowering of an optical density of a printed area and lowering a water fastness of printed image, although an absorbency for ink solvent is improved. With the crystallite size of more than 10.0 nm on the contrary, a haze occurs in an ink-receiving layer to lower a transparency, thereby impairing color tone and decreasing an optical density of printed images. Also, incorporated alumina is colored higher so that a color tone and an optical density of printed images are impaired and bright spots appear on the face of the recording medium.

It has been found out by the inventors of the present invention that there is a relation between an interplanar spacing of (020) plane and a crystallite size in a direction perpendicular to (010) plane as shown in FIGURE. Therefore, an adjustment of an interplanar spacing of (020) plane within the above range facilitates to control a crystallite size in a direction perpendicular to (010) plane within the range of from 6.0 to 10.0 nm. In a range of the interplanar spacing of not more than 0.617 nm, the crystallite size increases rapidly with the decrease of the interplanar spacing of (020) plane, which makes difficult the control of the crystallite size within the above range. In a range of the interplanar spacing of (020) plane of not less than 0.620 nm, the crystallite size will be smaller than the above range. By adjusting an interplanar spacing of (020) plane to be in the above range, the recording medium can be obtained which is suitable for greater varieties of ink dyes and satisfies the properties such as an ink absorbency, non-occurrence of cracking, powder-falling, curling and tacking, transparency, and so forth.

In another embodiment of the present invention, alumina hydrate in a recording medium can be adjusted to have, as a whole, the interplanar spacing of (020) plane of exceeding 0.617 nm but not more than 0.620 nm by using one or more kinds of alumina hydrate of a boehmite structure having an interplanar spacing of (020) plane of not more than 0.617 nm and other one or more kinds of alumina hydrate of a boehmite structure having an interplanar spacing of (020) plane of not less than 0.620 nm. By this method, the balance of the hydrophobicity and the hydrophilicity of alumina hydrate in the recording medium can be controlled more positively.

According to the findings by the inventors of the present invention, the relation between an interplanar spacing of (020) plane and a crystallite size in a direction perpendicular to (010) plane shown in FIGURE is correct, even when two or more kinds of alumina hydrate having an interplanar spacing of (020) plane different from each other are used in combination, and the crystallite size in a direction perpendicular to (010) plane can be controlled to be in the range of from 6.0 to 10.0 nm by adjusting an interplanar spacing of (020) plane, as a whole, to be exceeding 0.617 nm but not more than 0.620 nm.

There is also an advantage in that a selection scope for dyes for the ink can be made further broader by using strongly hydrophobic alumina hydrate having an interplanar spacing of (020) plane of not more than 0.617 nm and strongly hydrophilic alumina hydrate having an interplanar spacing of (020) plane of not less than 0.620 nm, in combination, and controlling the alumina hydrate in the recording medium to have, as a whole, the interplanar spacing of (020) plane of exceeding 0.617 nm but not more than 0.620 nm and the crystallite size in a direction perpendicular to (010) plane ranging from 6.0 to 10.0 nm.

The alumina hydrate useful in the present invention includes also the one containing a metal oxide such as titanium dioxide and silica provided that it exhibits a boehmite structure in X-ray diffraction.

Of the metal oxides, titanium dioxide is preferred in view of increasing a dye adsorption and not-impairing a dispersibility of the alumina hydrate. The titanium dioxide is contained preferably in an amount of from 0.01% to 1.00% by weight of the alumina hydrate for increase of dye adsorption. In this range, the optical density of a printed area is increased, and the water fastness of the printed area is improved. More preferably, the titanium dioxide is contained in the range of from 0.13% to 1.00% by weight, where dye absorption rate is higher and bleeding of dye and beading of ink are less liable to occur.

The content of titanium dioxide can be measured by melting the alumina hydrate with boric acid and analyzing the melt by ICP spectrometry. The distribution of the titanium dioxide in the alumina hydrate and the valence of the titanium can be measured by ESCA. The change of distribution of titanium dioxide content can be measured by etching the surface of the alumina hydrate by argon ion for 100 seconds and 500 seconds and observing it with ESCA. The titanium in the titanium oxide should have a valence of +4 for prevention of discoloration of the printed area. If the valence of the titanium is lower than +4, the titanium serves as a catalyzer to deteriorate the binder, tending to cause cracking and powder-falling, and discoloration of the dye in the print.

The titanium dioxide may be incorporated only on and around the surface of the aluminum hydrate, or into the interior thereof. The content may be varied from the surface to the interior. The incorporation of titanium dioxide only on the surface and in the vicinity thereof is preferred more since the bulk structure of the alumina hydrate crystal and the physical properties thereof can readily be maintained thereby. An example of titanium dioxide-containing alumina hydrate is shown, for example, in Japanese Patent Application 6-114670.

The aluminum hydrate may contain, in place of the aforementioned titanium dioxide, an oxide of magnesium, calcium, strontium, barium, zinc, boron, silicon, germanium, tin, lead, zirconium, indium, phosphorus, vanadium, niobium, tantalum, chromium, molybdenum, tungsten, manganese, iron, cobalt, nickel, ruthenium, or the like. However, titanium dioxide is the most suitable in view of adsorption of the dye in the ink and dispersibility thereof. Many of the above metal oxides are colored, while titanium dioxide is colorless. Titanium oxide is preferred in this respect.

The titanium dioxide-containing aluminum hydrate is produced preferably by hydrolysis of a mixed solution of aluminum alkoxide and titanium alkoxide as shown in "Hyomen no Kagaku" (Science of Surface) edited by K. Tamaru, p. 327 (1985), published by Gakkai Shuppan Senta. In another method, alumina hydrate is added as a crystal growth nucleus in the above hydrolysis of the mixed solution of aluminum alkoxide and titanium alkoxide.

The shape of the alumina hydrate particles can be observed by transmission electron microscopy with a specimen prepared by dropping a dispersion of alumina hydrate in water, alcohol, or the like onto a collodion membrane. Of the alumina hydrates, the one of pseudo-boehmite structure is known to include cilium-shaped one and others as described by Rocek, J, et al. (Applied Catalysis, Vol. 74, pp. 29–36 (1991)). The cilium-shaped aluminum hydrate and plate-shaped aluminum hydrate are both applicable in the present invention. The shape (particle shape, particle size, and aspect ratio) of the alumina hydrate particles can be observed by transmission electron microscopy with a specimen prepared by dropping a dispersion of alumina hydrate in deionized water onto a collodion membrane.

According to knowledge of the inventors of the present invention, plate-shaped aluminum hydrate is more dispersible in water than hair bundle-shaped (or cilium-shaped) aluminum hydrate, and is preferred, since the alumina hydrate particles are oriented at random, when an ink-receiving layer is formed, to provide a larger pore volume and broader distribution of pore diameter. The term "hair bundle-shaped" herein means a gathering state of needle-like alumina hydrate with the lateral side brought into contact with each other like a bundle of hair.

The "aspect ratio" of a plate-shaped particle can be measured by the method defined in Japanese Patent Publication 5-16015. The aspect ratio means a ratio of diameter to thickness of a particle. The diameter herein means a diameter of a circle having an area equivalent to the projected area of the particle of alumina hydrate observed by microscope or electron microscope. The "length-width ratio" is a ratio of the smallest diameter to the largest diameter of the projected area of the particle of aluminum hydrate observed similarly as the measurement of the aspect ratio. When the aluminum hydrate particle is hair bundle-shaped, the aspect ratio is a ratio of the length to the diameter upon measuring each diameter at top and bottom of circles and length, respectively, of individual needle-shaped alumina hydrate particle as a cylinder.

The plate-shaped alumina hydrate particles have preferably an average aspect ratio of from 3 to 30, and an average particle diameter of from 1 to 50 nm. The hair bundle-shaped alumina hydrate particles have preferably an average aspect ratio of from 3 to 10, and an average particle length of from 1 to 50 nm. Within the above range of the aspect ratio, because interstices are formed between the particles when an ink-receiving layer is formed or when incorporated in a fibrous material, a porous structure of broad pore radius distribution can be easily formed. Within the above range of the average particle diameter and the average particle length, a porous structure of larger pore volume can be formed similarly. With the average aspect ratio of smaller than the lower limit of the above range, the pore diameter distribution in the ink-receiving layer becomes narrower, and with the ratio larger than the upper limit of the above range, the alumina hydrate particles having non-uniform diameters are hardly produced. With the average particle diameter or the average particle length smaller than the lower limit of the above range, the pore diameter distribution tends to be narrower, and with the diameter larger than the upper limit of the above range, the ability of adsorbing a dye in an applied ink tends to be lowered.

The recording medium can be prepared by applying a dispersion of the above alumina hydrate onto a base material and drying of the coated matter to form an ink-receiving layer. Otherwise, the recording medium can be prepared by incorporating the dispersion into a fibrous material.

The BET specific surface area, the pore diameter distribution, the pore volume, and the isothermal nitrogen adsorption-desorption curve of the ink-receiving layer of the recording medium of the present invention are determined simultaneously by a nitrogen adsorption-desorption method. The BET specific surface area ranges preferably from 70 to 300 $m^2/g$. With the BET specific surface area smaller than the above range, the ink-receiving layer becomes white-turbid, or water fastness of the image becomes insufficient, whereas with the specific surface area larger than the above range, the ink-receiving layer is liable to cause cracking.

A first pore structure and a second pore structure shown below can be employed alone or in combination in the present invention, as needed.

The first pore structure of the ink-receiving layer has an average pore radius ranging from 2.0 to 20 nm, and a half width of pore radius distribution ranging from 2.0 to 15.0 nm. The average pore radius herein can be measured from the pore volume and the BET specific surface area as described in JP-A-51-38298, and JP-A-4-202011. The half width of the pore radius distribution is the range of the pore radius at half frequency of the average pore radius.

The dye in the ink is adsorbed selectively by pores of a specified radius as described in JP-A-4-267180 and JP-A-5-16517. Within the above ranges of the average pore radius and the half width of the pore radius distribution, the dye can be selected from greater varieties of dyes, and uniform optical density and uniform dot diameter can be obtained without dye bleeding, ink beading, and ink repulsion regardless of either hydrophobic or hydrophilic dyes. With the average pore radius larger than the above range, adsorption properties and fixability of a dye are lowered, and bleeding of an image is liable to occur, while, with the average pore radius smaller than the above range, the ink absorbency is lowered, and beading of ink is liable to occur. With the half width broader than the above range, the adsorption ability for a dye in an ink is lowered, while, with the half width narrower than the above range, the absorbency for a solvent component in an ink is lowered.

The pore volume in the ink-receiving layer ranges preferably from 0.4 to 0.6 $cm^3/g$ for sufficient ink absorbency. With the pore volume larger than the above range, the ink-receiving layer is liable to be cracked or to cause powder-falling, while, with the pore volume smaller than the above range, the ink absorbency tends to be lowered.

Further, the pore volume in the ink-receiving layer is preferably not less than 8 $cm^3/m^2$. Below this range, the ink tends to flow out and the formed image is liable to bleed, particularly in multicolor printing. The ink-receiving layer having the aforementioned broad pore radius distribution can be produced by a process disclosed, for example, in Japanese Patent Application 6-114671.

The second pore structure of the ink-receiving layer of the present invention has two or more peaks in pore radius distribution. The larger pores absorb a solvent component, and the smaller pores adsorb a dye. One of the peaks is preferably in the range of pore radius of not larger the 10.0 nm, more preferably from 1.0 to 6.0 nm. Within this range, dye adsorption is rapid. Another one of the peaks is preferably in the range of from 10.0 to 20.0 nm for rapid absorption of ink. If the former peak appears above the range, the adsorption ability and fixability for the dye is lowered, and bleeding and beading are liable to occur. If the latter peak appears below the aforementioned range, the absorbency for the solvent component in the ink is lowered, so that the ink drying is decelerated, and the recording medium is not dry when it is taken out from the recording apparatus. If the latter peak appears above the aforementioned range, the ink-receiving layer tends to have cracks.

The pore volume in the ink-receiving layer ranges preferably from 0.4 to 0.6 $cm^3/g$ for sufficient ink absorbency. With the pore volume larger than the above range, the ink-receiving layer is liable to be cracked or to cause powder-falling, while, with the pore volume smaller than the above range, the ink absorbency tends to be lowered.

Further, the pore volume in the ink-receiving layer is preferably not less than 8 $cm^3/m^2$. Below this range, the ink tends to flow out and image bleeding is liable to occur, particularly in multicolor printing. A pore volume ratio of peaks having a maximum pore radius of not larger than 10.0 nm, the Volume ratio of Peak 2, can be obtained from a ratio of a twice value of a pore volume to the total pore volume, upon measuring the pore volume having a pore radius to provide a maximum pore radius of not larger than 10.0 nm, but this value ranges preferably from 0.1% to 10%, more preferably from 1% to 5% of the entire pore volume for satisfying both the ink absorbency and the dye fixability. Within this range, the ink absorption rate and the dye adsorption rate are high. The above-described ink-receiving layer having two or more peaks in the pore radius distribution can be formed by a process, for Example, disclosed in Japanese Patent Application 6-114669.

The properties shown below are common to the first and the second pore structures in the present invention.

The isothermal nitrogen adsorption-desorption curve can be obtained by a nitrogen adsorption-desorption method in a similar manner as the pore volume and the pore radius distribution. The relative pressure difference ($\Delta P$) between the adsorption and desorption is preferably not higher than 0.2 at 90% of the maximum amount of adsorbed gas found from an isothermal nitrogen adsorption-desorption curve for the ink-receiving layer. The relative pressure difference ($\Delta P$) can be use as a measure for the possibility of existence of an inkpot-shaped pore as described by McBain (J. Am. Chem. Soc., Vol. 57, p. 699 (1935). At lower relative pressure difference ($\Delta P$), the pores are in a shape like a straight tube, while at a higher relative pressure difference, the pores are in a shape like an inkpot. With the relative pressure difference more than the above range, drying of the ink after printing is slow, and the recording medium is discharged from the recording apparatus with its surface in a wet state.

The pore structure of the ink-receiving layer does not depend the kind of alumina hydrate employed, but depends on the production conditions of the ink-receiving layer including the kind and mixing ratio of the binder; the concentration, viscosity, and dispersion state of the coating liquid; the coating apparatus; the type of coating head; the coating amount; the flow rate, temperature, and blowing direction of the drying air; and so forth. Therefore, the production conditions should be controlled to be optimum in order to obtain the desired properties of the ink-receiving layer of the present invention.

The alumina hydrate employed in the present invention may contain additives. The additive is selected arbitrarily from metal oxides, salts of divalent or higher-valent metals, and cationic organic substance. The metal oxides include silica, silica-alumina, boria, silica-boria, magnesia, silica-magnesia, titania, zirconia and zink oxide, and hydroxides thereof. The salts of divalent or higher-valent metals include salts such as calcium carbonate, and barium sulfate; halide salts such as magnesium chloride, calcium bromide, calcium iodide, zinc chloride, zinc bromide, zinc iodide; calcium nitrate, kaolin, and talc. The cationic organic compounds include quaternary ammonium salts, polyamines, and alkylamines. The additive is added in an amount preferably of not more than 20% by weight of the alumina hydrate.

The binder employed in the present invention is selected from one or more kinds of water-soluble polymers. The water-soluble polymers include polyvinyl alcohols and modifications thereof, starch and modifications thereof, gelatin and modifications thereof, casein and modifications thereof, gum arabic, cellulose derivatives such as carboxymethylcellulose, polyvinylpyrrolidone, and maleic anhydride polymer and copolymer thereof. The water-soluble polymers further include aqueous polymer dispersion such as conjugated diene copolymer latex, e.g., SBR latex, etc., functional group-modified polymer latex, and vinyl copolymer latex such as ethylene-vinyl acetate copolymers, and so forth.

The mixing ratio of the alumina hydrate to the binder is selected arbitrarily in the range of from 5:1 to 20:1 by weight. This range is preferable because a medium absorbs inks faster, an optical density at printed portions will be higher and a cracks and a powder-falling will be less caused. With the amount of the binder less than the above range, the ink-receiving layer has insufficient mechanical strength, and is liable to be cracked or to cause powder-falling, while with the amount thereof more than the above range, the pore volume tends to be less and the ink absorbency tends to be lowered. In consideration of the balance of the ink absorbency and the less liability of cracking, the mixing ratio of alumina hydrate to the binder ranges preferably from 7:1 to 15:1.

In addition to the alumina hydrate and the binder, there may be added, in the present invention, a pigment dispersant, a thickener, a pH controller, a lubricator, a fluidity modifier, a surfactant, an antifoaming agent, a waterproofing agent, a foam inhibitor, a releasing agent, a blowing agent, a penetrating agent, a coloring dye, a fluorescent whitener, an ultraviolet absorber, an antioxidant, an antiseptic agent, a mildewproofing agent, and the like. The waterproofing agent may arbitrarily be selected from known materials such as quaternary ammonium salts, and polymeric quaternary ammonium salts.

The base material for the ink-receiving layer in the present invention, may be a paper sheet such as a sized paper sheet, a non-sized paper sheets, and a resin-coated paper, such as polyethylene paper; or a sheet-shaped material such as a thermoplastic resin film. The thermoplastic resin film may be a transparent film of a resin such as polyester, polystyrene, polyvinyl chloride, polymethyl methacrylate, cellulose acetate, polyethylene, and polycarbonate; or a pigment-filled or finely-foamed opaque plastic sheet.

The recording medium of the present invention may be produced by a usual process of coating or incorporation of alumina hydrate. One or more of the four processes below may be employed, although the process is not limited thereto.

A first process comprises steps of preparing a dispersion of alumina hydrate from a sol or dry powder of alumina hydrate having an interplanar spacing of (020) plane of exceeding 0.617 nm but not more than 0.620 nm; and applying the dispersion onto a base material or incorporating the dispersion into a fibrous material to produce, without changing an interplanar spacing of (020) plane of alumina hydrate, a recording medium containing alumina hydrate having an interplanar spacing of (020) plane of exceeding 0.617 nm but not more than 0.620 nm.

The crystal structure of the alumina hydrate acquires a thermal hysteresis during the production process as described above, and the crystal structure such as a boehmite structure does not change at a later heat treatment at a temperature lower than the highest temperature during the alumina hydrate production. Therefore, a recording medium can be produced without changing the crystal structure such as an interplanar spacing of alumina hydrate by conducting the steps of producing the recording medium from the alumina hydrate at temperatures below the transition point of alumina hydrate and below the highest temperature in the alumina hydrate production.

A second process comprises steps of preparing a dispersion of alumina hydrate from one or more kinds of sol or dry powder of alumina hydrate having an interplanar spacing of (020) plane of not more than 0.617 nm and other one or more kinds of sol or dry powder of alumina hydrate having an interplanar spacing of (020) plane of not less than 0.620 nm; and applying the dispersion onto a base material, or incorporating the dispersion into a fibrous material and forming a paper sheet therefrom to produce a recording medium containing alumina hydrate having an interplanar spacing of (020) plane of exceeding 0.617 nm but not more than 0.620 nm.

The mixing ratio of the alumina hydrate having an interplanar spacing of (020) plane of not more than 0.617 nm to the other alumina hydrate having an interplanar spacing of (020) plane of not less than 0.620 nm is not specially limited provided that the interplanar spacing of the alumina hydrate in the recording medium can be brought into the above range. The mixing ratio, however, ranges preferably from 10:1 to 1:10. Within this range, the interplanar spacing of (020) plane of alumina hydrate in the recording medium can readily be adjusted to the above intended spacing. It is more preferably in a range of from 5:1 to 1:5. Within the above range, the viscosity of the alumina hydrate dispersion changes less with time.

A third process comprises steps of preparing a dispersion of alumina hydrate from a sol or dry powder of alumina hydrate having an interplanar spacing of (020) plane of not less than 0.620 nm; and applying the dispersion onto a base material, or incorporating the dispersion into a fibrous material; and drying the resulted material to produce a recording medium containing alumina hydrate having an interplanar spacing of (020) plane of exceeding 0.617 nm but not more than 0.620 nm.

As described before, the crystal structure of alumina hydrate such as an interplanar spacing can be reduced by heating the alumina hydrate at a temperature higher than the highest temperature in the alumina hydrate production process but below the transition temperature thereof. The heating treatment may be conducted in the dispersion stage in an autoclave, or during the drying step, or by additional heating after the drying step.

In this method, an interplanar spacing of (020) plane is reduced by elimination of water between the layers as mentioned above. Therefore, the heating temperature and time should be controlled so as to obtain an interplanar spacing of (020) plane within the predetermined range. Generally, the temperature is a more dominant factor than the heating time. The higher the heating temperature elevates, or the longer the heating time takes, the smaller the interplanar spacing of (020) plane will become reduced.

In order to bring an interplanar spacing of (020) plane of the alumina hydrate in the recording medium into the above-specified range, the treating conditions such as heating temperature and heating time can be decided preliminarily for obtaining the recording medium having the interplanar spacing of (020) plane within a range mentioned above by varying the heating conditions of the alumina hydrate dispersion in the steps in the recording medium production process.

A forth process comprises steps of preparing a sol or powder of alumina hydrate having an interplanar spacing of (020) plane of exceeding 0.617 nm but not more than 0.620 nm by subjecting a sol or powder of alumina hydrate having an interplanar spacing of (020) plane of not more than 0.617 nm to a wet- or dry-trituration treatment; preparing a dispersion of alumina hydrate using such an alumina hydrate in the same manner as in the above first process; and applying the dispersion onto a base material or incorporating the dispersion into a fibrous material to produce, without changing the interplanar spacing of (020) plane of alumina hydrate, a recording medium containing alumina hydrate having the interplanar spacing of (020) plane of exceeding 0.617 nm but not more than 0.620 nm.

The trituration treatment of the dispersion containing alumina hydrate is conducted by a conventional method, preferably by gentle stirring with a homomixer or a rotating blade rather than vigorous stirring with a grinding type dispersing machine like a ball mill or a sand mill.

The shearing stress to be applied depends on a viscosity, an amount, and a volume of a dispersion, and ranges preferably from 0.1 to 100.0 $N/m^2$ (1 to 1,000 $dyn/cm^2$). Within this range, a viscosity of an alumina hydrate dispersion can be reduced without changing a crystal structure of the alumina hydrate, and a particle size of the alumina hydrate can be reduced sufficiently. Thereby binding points of the alumina hydrate with a binder, a base material, and a fibrous material can be increased, which prevents cracking and powder-falling. Above the upper limit of the range, the dispersion may gel, or a crystal structure of the alumina hydrate may be changed to be amorphous. Below the lower limit of the range, a dispersion state is insufficient, and precipitate tends to be formed in the dispersion, or aggregated particles may remain in the recording medium to cause haze or low transparency, or to cause drop-off of particles or cracking of the recording layer.

The more preferred range is from 0.1 to 50.0 $N/m^2$. Within this range, aggregated particles of the alumina hydrate is broken into fine particles without reducing the pore volume. Thereby, formation of pores of excessively large radius is prevented, delamination and cracking of the ink-receiving layer on folding is prevented, and haze of the ink-receiving layer caused by large particles is reduced in the recording medium. A still more preferred range is from 0.1 to 20.0 $N/m^2$. Within this range, a mixing ratio of the alumina hydrate to a binder in the recording medium can be kept constant, powder-falling and cracking are prevented, and the optical density and the diameter of printed dots can be made uniform.

Although a dispersing time depends on an amount of a dispersion, a size of container, temperature of a dispersion and so forth, it is preferably not longer than 30 hours in view of prevention of change of the crystal structure. Still more preferably it is not longer than 10 hours for controlling the pore structure within a range as described above. A dispersion treatment may be conducted at a constant temperature by means of cooling or heat insulation. A preferred temperature ranges from 10° to 100° C., depending on a dispersion treatment method, materials, and a viscosity. At a lower temperature, the dispersion treatment is insufficient, or aggregation occurs. At a higher temperature, the dispersion gels, or the crystal structure is changed to amorphous.

Application of the alumina hydrate dispersion for forming the ink-receiving layer of the present invention can be conducted with a conventional coating apparatus such as a blade coater, an air-knife coater, a roll coater, a brush coater, a curtain coater, a bar coater, a gravure coater, and a spray coater.

A coating amount of the dispersion ranges preferably from 0.5 to 60 g/m$^2$ in terms of dry solid for sufficient ink absorbency, more preferably from 5 to 45 g/m$^2$ for high ink absorption rate and prevention of cracking and of powder-falling. If necessary, a surface smoothness of the ink-receiving layer may be improved by calendering after the coating.

Incorporation of the alumina hydrate dispersion in a fibrous material in a paper sheet forming process in the present invention can be conducted by means of a Fourdrinier paper machine, a circular drum, a twin wire, or combination thereof. An amount of incorporated alumina hydrate ranges preferably from 1% to 20% in terms of dry solid for increasing an ink dye adsorption, more preferably from 5% to 15% for obtaining a high optical density of a printed area and preventing powder-falling. If necessary, a surface smoothness may be improved by use of a size press or a calender roll.

The recording medium containing the alumina hydrate incorporated therein of the present invention may contain, if necessary, a sheet strength improver, a retention aid, or a coloring matter. The retention aid includes cationic retention aids such as cationic starch, and dicyandiamide-formalin condensates, and anionic retention aids such as anionic polyacrylamide, and anionic colloidal silica, and combination of one or more thereof.

The ink employed in the image formation of the present invention comprises mainly a coloring matter (dye or pigment), a water soluble organic solvent, and water. The dye is preferably a water-soluble dye including direct dyes, acid dyes, basic dyes, reactive dyes, and food dyes, provided that the dye is capable of giving an image satisfying the required properties such as fixability, coloring properties, sharpness, stability, and light-fastness in combination of the recording medium of the present invention.

The water-soluble dye is used in a state of a solution in water or in a solvent composed of water and a water-soluble organic solvent. The solvent is preferably a mixture of water and a water-soluble organic solvent. A water content in the ink ranges preferably from 20% to 90% by weight.

The organic solvent includes alkyl alcohols of 1 to 4 carbon atoms such as methyl alcohol; amides such as dimethylformamide; ketones and ketone alcohols such as acetone; ethers such as tetrahydrofuran; polyalkylene glycols such as polyethylene glycol; alkylene glycols having 2 to 6 carbon atoms such as ethylene glycol; glycerin; lower alkyl ethers of polyhydric alcohols such as ethylene glycol methyl ether. Of these water-soluble organic solvents, preferred are polyhydric alcohols such as diethylene glycol; and lower alkyl ethers of polyhydric alcohols such as triethylene glycol monomethyl ether, and triethylene glycol monoethyl ether. The polyhydric alcohols are particularly preferred as a lubricant for preventing nozzle clogging caused by deposition of the water-soluble dye by evaporation of water from the ink.

The ink may contain a solubilizer. Typical solubilizers include nitrogen-containing cyclic ketones. The solubilizer is employed to increase remarkably a solubility of the water-soluble dye in the solvent. Specific examples of the solubilizer are N-methyl-2-pyrrolidone, and 1,3-dimethyl-2-imidazolidinone. For further improvement of the properties, there may be added to the ink an additional additive such as a viscosity controlling agent, a surfactant, a surface-tension controlling agent, a pH controlling agent, a resistivity controlling agent, etc.

An ink-jet recording method is employed for forming images on the above described recording medium. Any type of ink-jet recording method is useful which eject ink-droplets through a fine orifice effectively to apply ink onto the recording medium. A particularly useful ink-jet recording method is the one disclosed in JP-A-54-59936 in which an ink changes its volume abruptly by action of thermal energy and the ink is ejected by the pressure caused by the volume change.

The recording medium of the present invention is different from the recording media of the above-cited prior arts employing pseudo-boehmite as below.

1. JP-A-5-32413 and JP-A-5-32414 disclose an alumina sol having a crystallite size in a direction perpendicular to (010) plane of not less than 6.0 nm or not less than 7.0 nm, and a recording medium employing an alumina sol.

It is known, however, that a crystallite size in a direction perpendicular to (010) plane and an interplanar spacing of (020) plane of alumina hydrate of a boehmite structure are increased by a heat treatment and decreased by a trituration treatment. In producing the recording medium, the alumina hydrate is mixed with a binder, and is subjected to various treatment such as coating and drying. Therefore, the alumina hydrate in the recording medium does not have the same crystal structure as the starting alumina hydrate.

The above JP-A publications describe neither a crystallite size of an alumina hydrate formed from an alumina sol in a recording medium or an ink-receiving layer, nor conditions of dispersing treatment of an alumina sol and of production of a recording medium. On the other hand, in the present invention a crystallite size of alumina hydrate in a recording medium is controlled to be in a range of from 6.0 to 10.0 nm in a direction perpendicular to (010) plane of an alumina hydrate to obtain a recording medium which is excellent in transparency, ink absorbency, and dye adsorption properties, and does not cause cracking. Therefore, the present invention is different in technical thought from the prior arts.

2. JP-A-5-32414 discloses alumina sol having an interplanar spacing of (020) plane of not more than 0.617 nm and a recording medium employing an alumina sol, and also discloses that optical density of a printed area is higher with a smaller interplanar spacing of (020) plane in printing with a certain kind of dye.

An interplanar spacing of (020) plane of alumina hydrate in a recording medium is not the same as that of the starting alumina sol as described above. However, the above publication discloses neither an interplanar spacing of (020) plane in the recording medium nor production conditions of the recording medium. The present invention is based on a thought to optimize a balance in quantity of hydrophobic moieties and hydrophilic moieties on an alumina hydrate by controlling an interplanar spacing of (020) plane to be exceeding 0.617 nm but not more 0.620 nm. Thereby, dyes and a composition of an ink can be selected from a broader range, and an optical density of a printed area and a dot diameter can be uniform, dye bleeding is prevented, and a color balance is improved, even when either an ink containing a hydrophilic dye, or an ink containing a hydrophobic dye is employed, or a combination of inks above is employed.

Another embodiment of the present invention controls more positively a balance of a hydrophilicity and a hydrophobicity by combining an alumina hydrate having an interplanar spacing of (020) plane of not more than 0.617 nm and another one having that of not less than 0.620 nm. Such a technical thought idea is not shown in the prior arts.

3. In JP-A-5-32414 a crystallite size in a direction perpendicular to (010) plane and an interplanar spacing of (020) plane are specified. However, a relation of the two characteristic values is not shown.

In the present invention, it has been found that a crystallite size in a direction perpendicular to (010) plane of the alumina hydrate becomes remarkably large at an interplanar spacing of (020) plane of 0.617 nm or less as shown in FIGURE. It has also been found that a crystallite size in a direction perpendicular to (010) plane can be controlled to be in the range of from 6.0 to 10.0 nm by adjusting an interplanar spacing of (020) plane to be larger than 0.617 nm. In other words, both the desired interplanar spacing of (020) and the desired crystallite size in a direction perpendicular to (010) plane can be obtained in the range of an interplanar spacing of (020) plane of larger than 0.617 nm but not larger than 0.620 nm. Therefore, by controlling an interplanar spacing of (020) plane to be in the above range, the ratio of a hydrophilicity to a hydrophobicity in the recording medium is optimized to broaden a selection range of dyes, and the crystallite size in a direction perpendicular to (010) plane is controlled to be in the range of from 6.0 to 10.0 nm, whereby a transparent ink-receiving layer can be obtained, and cracking and powder-falling can be prevented. The present invention is based on a thought to optimize both the interplanar spacing of (020) plane and the crystallite size in a direction perpendicular to (010) plane simultaneously, which is different from prior art techniques. A crystallite size in a direction perpendicular to (010) plane around 0.617 nm of an interplanar spacing of (020) plane is not described in prior publications.

4. A recording medium having a specified peak in a pore radius distribution is disclosed in prior arts, and an ink absorbency and a printing density are improved by controlling a pore radius and a pore volume. On the contrary, in the present invention an ink absorbency and a print density are further improved by optimizing not only the pore radius distribution and the pore volume but also an interplanar spacing and a crystallite size of an alumina hydrate in a recording medium.

The present invention will be described in more detail by reference to examples without limiting the invention in any way.

Physical properties used in the present invention were measured by the procedures below.

1. Interplanar spacing of (020) plane, and crystallite size in a direction perpendicular to (010) plane:

An alumina hydrate in a dry powder state, or a recording medium in a sheet state was set on the sample stand of an X-ray diffraction measurement apparatus, and a diffraction angle and a half width of a peak of (020) plane were measured.

Apparatus: RAD-2R (produced by Rigaku Denki K.K.)
Target: CuKα
Optical system: Wide angle goniometer (with curved graphite monochrometer)
Gonio radius: 185 mm
Slits: DS 1°, RS 1°, SS 0.15 mm
X-ray source: Tube voltage 40 kV Tube current 30 mA
Measurement: 2θ-θ method taken data every 0.002° for 2θ Continuous scanning, 2Θ=10° to 30°, 1°/min Interplanar spacing (d), calculated by the Bragg's equation:

$$d=\lambda/2 \sin \theta \quad \text{(Equation 1)}$$

Crystallite size (E), calculated by the Scherrer's equation:

$$E=0.9\lambda/B \cos \theta \quad \text{(Equation 2)}$$

where λ is a wavelength of X-ray, 2θ is a peak diffraction angle, and B is a half width of a peak.

2. BET specific surface area, pore radius distribution, pore volume, and isothermal desorption characteristics:

A recording medium was heated and deaerated sufficiently before the measurement, and was subjected to measurement by a nitrogen adsorption-desorption method. Measurement apparatus: Autosorb 1 (Quanthchrome Co.).

A BET specific surface area was calculated according to the method of Brunauer, et al. (J. Am. Chem. Soc., Vol. 60, p. 309, (1938)).

A pore volume was calculated according to the method of Barrett, et al. (J. Am. Chem. Soc., Vol. 73, p. 373 (1951)).

An average pore radius (r) was calculated by the method of Gregg, et al. ("Adsorption Surface Area and Porosity", Academic Press (1967))

$$r=PV\times 2/SA \quad \text{(Equation 3)}$$

where PV is a pore volume, and SA is a specific surface area.

A half width of a pore radius distribution was calculated from a width of a pore radius which is a half frequency of the average pore radius in the pore radius distribution curve.

A pore volume ratio of peaks having a maximum at not larger than 10.0 nm of pore radius, the Volume ratio of Peak 2, was obtained from a ratio of a twice value of a pore volume to a total pore volume, by measuring the pore volume having a pore radius to provide a maximum value at not larger than 10.0 nm of pore radius.

A relative pressure difference (ΔP) between the adsorption pressure and the desorption pressure at 90% of maximum amount of adsorbed gas was obtained from an isothermal nitrogen adsorption-desorption curve.

3. Analysis of titanium dioxide:

An amount of titanium dioxide in alumina hydrate was obtained by melting the sample salt, by means of an ICP method (SPS4000, produced by Seiko Electronic Co.).

A distribution of titanium dioxide in the alumina hydrate was measured by ESCA (Model 12803, produced by Surface Science Instruments Co.). A surface of the alumina hydrate was etched with argon ion for 100 seconds, and 500 seconds, and a change in a titanium content was measured.

4. Particle shape:

A specimen was prepared by dropping a dispersion of alumina hydrate in deionized water onto a collodion membrane. This specimen was observed by transmission electron microscope (H-500, produced by Hitachi Ltd.) to obtain an aspect ratio, an average particle size, and a particle shape.

5. Transition temperature:

An alumina hydrate sol was air-dried at a temperature of 20° C. The obtained alumina hydrate was ground in a mortar, and was subjected to a measurement by a thermoanalyzer (PC, produced by Perkin Elmer Co.) to obtain a TG-DTA curve.

6. Transparency:

Alumina hydrate was applied onto a transparent PET film to prepare a test sample, the haze of which was measured by a haze meter (NDH-1001DP, produced by Nippon Denshoku K.K.) according to JIS K-7105.

7. Resistance to Cracking:

Alumina hydrate was applied onto a transparent PET film to prepare a test specimen, and a crack length on the specimen was examined visually. The test specimen which had no crack of 1 mm or longer was evaluated as "good".

The test specimen which had no crack of 5 mm or longer was evaluated as "fair". The test specimen which had cracks of 5 mm or longer was evaluated as "poor".

8. Resistance to Powder-Falling:

A test piece of the fibrous material sheet having alumina hydrate incorporated therein was folded down at the center. The sheet material which did not fall a powder of 1 mm or longer was evaluated as "good". The one which did not fall a powder of 5 mm or longer was evaluated as "fair". The one which fall a powder of 5 mm or longer was evaluated as "poor".

9. Resistance to Curling:

A sample of a transparent PET film coated with alumina hydrate, or a sample of fibrous material containing alumina hydrate incorporated therein was cut into a test piece in a size of 297 mm×210 mm. The test piece was left laying on a flat plate, and a degree of curling was measured with a height gauge. The sample which curled not more than 1 mm was evaluated as "good". The one which curled not more than 3 mm was evaluated as "fair". The one which curled more than 3 mm was evaluated as "poor".

10. Resistance to Tacking:

A recording medium was tested by touching the surface with a finger. The recording medium which gave no tackiness feeling was evaluated as "good". The one which gave tackiness feeling was evaluated as "poor".

11. Printing characteristics:

Ink-jet recording was conducted by an ink-jet printer provided with an ink-jet head having 128 nozzles for four colors of Y, M, C, and Bk with a nozzle spacing of 16 nozzles per mm by use of inks having compositions as shown below, in an amount of each ink of 30 ng per one dot. Evaluations were made regarding an ink absorbency, an image density, an ink bleeding, an ink beading, an ink repulsion, and dot diameters.

11-1. Ink-absorbency:

Solid printing was conducted with Y, M, C, and Bk inks in a single color, respectively, or in multicolor. Immediately thereafter, an ink drying state at the surface of an ink-receiving layer was tested by finger touch. An amount of ink used for single color printing was prescribed to be 100% (16×16 dots per square mm). Similarly, upon printing with three color inks in an amount of 100%, respectively, an ink absorbency of a recording medium was evaluated to be "good" when the ink did not transfer to the finger with an amount of the ink of 300%; to be "fair" when the ink did not transfer to the finger with an amount of 100%; and to be "poor" when the ink transferred to the finger with an amount of 100%.

11-2. Image density:

Solid printing was conducted with Y, M, C, and Bk inks in a single color, respectively, with an amount of ink of 100%. The image density was measured with a McBeth Reflecto-Densitometer (RD-918). A recording medium provided with an ink-receiving layer on a transparent base material was subjected to a measurement by putting an electrophotographic paper sheet (EW-500, produced by Canon K.K.) on a side of recording medium where an ink-receiving layer was not provided.

11-3. Resistance to Bleeding, Beading and Repulsion:

Solid printing was conducted with Y, M, C, and Bk inks in a single color, respectively, or in multicolor. Bleeding, beading, and repulsion of the ink at the surface of the recording medium were examined visually. An amount of ink used for single color printing was prescribed to be 100%. A recording medium was evaluated to be "good" when these phenomena were not observed with an amount of the ink of 300%; to be "fair" when the phenomena were not observed with an amount of ink of 100%; and to be "poor" when the phenomena were observed with an amount of ink of 100%.

11-4. Dot diameter:

One dot was printed with Y, M, C, and Bk inks in a single color using the printer above, respectively, with an amount of ink of 100%. The diameters of the printed dots were measured with a microscope.

Ink Composition A for M, C, and Bk inks:

5 parts of Dye,
5 parts of Diethylene glycol,
20 parts of Polyethylene glycol, and
70 parts of Water.

Dyes used for inks:

M: C.I. Acid Red 35
C: C.I. Direct Blue 199
Bk: C.I. Food Black 2

Ink Composition B for Y ink 50 parts of C.I. Disperse Yellow 42 (10% dispersion),
25 parts of Diethylene glycol, and
25 parts of Water.

EXAMPLES 1 AND 2

Aluminum dodecyloxide was prepared according to the method described in U.S. Pat. No. 4,242,271. Then the resulting aluminum dodecyloxide was hydrolysed into an alumina slurry according to the method described in U.S. Pat. No. 4,202,870. This alumina slurry was diluted with water to a content of solid alumina hydrate of a boehmite structure of 7.9%. The alumina slurry showed pH of 9.5. The pH was adjusted by adding a 3.9% nitric acid solution to a pH before aging as shown in Table 1. The alumina slurry was aged under the conditions shown in Table 1 to obtain a colloidal sol of alumina hydrate. This colloidal sol was spray-dried at an inlet temperature of 120° C. to obtain powdery alumina hydrate, which had a crystal structure of boehmite, and in a form of a plate-shaped particles. Properties of the alumna hydrate were measured as described above. The measured properties are shown in Table 1.

Separately, polyvinyl alcohol (Gosenol NH18, produced by Nippon Gosei Kagaku K.K.) was dissolved in deionized water at a concentration of 10% by weight. The alumina hydrate of Example 1 or 2 was dispersed in deionized water at a concentration of 15% by weight. The alumina hydrate dispersion and the polyvinyl alcohol solution were mixed at a solid component ratio of polyvinyl alcohol to alumina hydrate of 1:5 by weight, and the mixture was homogenized by a Homomixer (produced by Tokushu Kika K.K.) at 8,000 rpm/min for 30 minutes to obtain a mixture dispersion. The mixture dispersion was applied on a transparent PET film (Lumirror, produced by Toray Industries, Inc.) of 100 μm thick by die coating. The PET film having been coated with the dispersion was heated and dried at 100° C. for 30 minutes in an oven to obtain a recording medium having an ink-receiving layer of 30 μm thick. Properties of the ink-receiving layer were measured by the methods described above. The results are shown in Table 1.

EXAMPLES 3 AND 4

Aluminum dodecyloxide was prepared in the same manner as in Example 1. Then a part of the aluminum dodecyloxide was hydrolyzed in the same manner as in Example 1 to obtain an alumina slurry. A remained part of aluminum dodecyloxide was mixed with isopropyltitanium (produced by Kishida Kagaku K.K.) at a mixing ratio of 100:5 by weight. The mixture was hydrolysed in the same manner as in Example 1 employing the above alumina slurry as a crystal seed to obtain a titanium dioxide-containing alumina slurry. This alumina slurry was diluted with water to a solid alumina hydrate content 7.9%. The alumina slurry showed pH of 9.5. The pH was adjusted by adding a 3.9% nitric acid solution to a pH before aging as shown in Table 1. The alumina slurry was aged under the conditions shown in Table 1 to obtain a colloidal sol of alumina hydrate. This colloidal sol was spray-dried in the same manner as in Example 1 to obtain alumina hydrate, which had a boehmite structure, and was in a form of a plate-shaped particles as same as in Example 1. Properties of the alumna hydrate were measured as described above. The measured properties are shown in Table 1. The titanium dioxide was contained only at and near surface of the alumina hydrate particles.

Titanium dioxide-containing aluminum hydrate was dispersed in deionized water in the same solid content as in Example 1. The resulting dispersion was mixed with the polyvinyl alcohol dispersion as in Example 1 in the same pigment/binder solid mixing ratio as in Example 1, and the mixture was homogenized in the same manner as in Example 1. The dispersion was applied on a transparent PET film same as in Example 1. The PET film having been coated with the dispersion was heated and dried in the same manner as in Example 1 to obtain a recording medium having an ink-receiving layer of the same dry thickness as in Example 1. Properties of the ink-receiving layer were measured by the methods described above in the same manner as in Example 1. The results are shown in Table 2.

EXAMPLES 5 TO 8

Aluminum dodecyloxide was prepared in the same manner as in Example 1. The aluminum dodecyloxide was hydrolyzed to obtain an alumina slurry in the same manner as in Example 1 (Examples 5 and 6). Titanium dioxide was added in the same manner as in Example 3 (Examples 7 and 8). The pH and the solid content of the alumina slurry was adjusted in the same manner as in Example 1. The alumina slurry was aged under the conditions shown in Table 1 to obtain a colloidal sol of the alumina hydrate. The resulting colloidal sol of alumina hydrate was concentrated to a solid concentration of 15%. The colloidal sol of the alumina hydrate was spray-dried in the same manner as in Example 1 at the inlet temperature of 90° C. to obtain powdery alumina hydrate. Properties of the alumna hydrate were measured as described above. The measured properties are shown in Table 1.

Using the alumina hydrate, a recording medium was prepared in the same manner as in Example 1 except that the coated PET film was dried at a temperature of 125° C. Properties of the ink-receiving layer were measured in the method described above in the same manner as in Example 1. The results are shown in Table 2.

EXAMPLES 9 TO 12

Aluminum dodecyloxide was prepared in the same manner as in Example 1. The aluminum dodecyloxide was hydrolyzed to obtain an alumina slurry in the same manner as in Example 1 (Examples 9 and 10). Titanium dioxide was added in the same manner as in Example 3 (Examples 11 and 12). The pH and the solid content of the alumina slurry was adjusted in the same manner as in Example 1. The alumina slurry was aged under the conditions shown in Table 3 to obtain each of eight colloidal sols of alumina hydrate. The resulting colloidal sol of alumina hydrate was concentrated to a solid concentration of 10%. The colloidal sol of the alumina hydrate was spray-dried at a temperature shown in Table 3 to obtain powdery alumina hydrate. The alumina hydrate had a boehmite structure. Properties of the alumna hydrate were measured as described above. The measured properties are shown in Table 3.

Each two kinds of dried powdery alumina hydrate (in Examples having a same number marked with a and b in Table 3) were mixed in a solid matter ratio of 1:1 by weight, and the mixture was dispersed in deionized water in the same solid matter concentration as in Example 1. Then, a polyvinyl alcohol dispersion same as in Example 1 was added to the mixed alumina dispersion in the same pigment/binder ratio as in Example 1, and the dispersion mixture was homogenized in the same manner as in Example 1. The homogenized dispersion was applied on a PET film same as in Example 1 so as to obtain the same dry thickness as in Example 1. The PET film coated with the dispersion was heated and dried at 80° C. for 30 minutes in an oven to obtain a recording medium having an ink-receiving layer of 30 μm thick. Properties of the ink-receiving layer were measured as described above in the same manner as in Example 1. The results are shown in Table 4.

EXAMPLES 13 TO 16

As the starting pulp materials, were used 80 parts of broad-leaved tree bleached kraft pulp (LBKP) having a freeness (C.S.F.) of 370 ml and 20 parts of needle-leaved tree kraft pulp (NBKP) having a freeness of 410 ml. Thereto, the alumina hydrate of Example 1, 2, 3, or 4 was added as the filler in an amount of 10% by weight based on the solid matter of the pulp, and cationic starch (CATOF, produced by Oji National K.K.) in an amount of 0.3% by weight based on the solid matter of the pulp as a retention aid. Further, immediately before the paper sheet formation, a polyacrylamide type retention aid (Pearl Flock FR-X, produced by Seiko Kagaku Kogyo K.K.) was added in an amount of 0.05% by weight. The mixture was formed into sheet having a basis weight of 70 g/m$^2$ by means of a TAPPI standard sheet former. Then, a 2% solution of oxidized starch (MS 3800, produced by Nippon Shokuhin K.K.) was applied by a size press to the sheet, which was dried at 100° C. to obtain a recording medium. The test results are shown in Table 5.

EXAMPLES 17 TO 20

A paper sheet was formed respectively in the same manner as in Example 13 except that a colloidal sol of one of Examples 5 to 8 was used. Then the oxidized starch solution of the same concentration as in Example 13 was applied to the formed sheet by means of the same size press as in Example 13, and the sheet was dried at 135° C. to obtain a recording medium. The test results are shown in Table 5.

EXAMPLES 21 TO 24

A paper sheet was formed respectively in the same manner as in Example 13 except that the alumina hydrate of Example 9 to 12 was used in the same combination as in Example 9 to 12. Then the oxidized starch solution of the same concentration as in Example 13 was applied to the formed sheet by means of the same size press as in Example 13, and the sheet was dried at 90° C. to obtain a recording medium. The test results are shown in Table 6.

Comparative Examples 1 to 4

A colloidal sol of alumina hydrate was prepared respectively in the same manner as in Example 1 or 2. The sol was dried with a spray drier same as in Example 1 at an inlet temperatures of 80° C. in case of Comparative Examples 1 and 3 or 180° C. in case of Comparative Examples 2 and 4 to obtain powdery alumina hydrate. Here, in Comparative Examples 1 and 2 the colloidal sol of alumina hydrate of Example 1 is used, and in Comparative Examples 3 and 4 the colloidal sol of alumina hydrate of Example 2 is used. A recording medium was prepared in the same manner as in Example 1 except that the above alumina hydrate was used. Properties of the ink-receiving layer were measured by the aforementioned methods in the same manner as in Example 1. The test results are shown in Table 7.

Comparative Examples 5 to 8

Powdery alumina hydrates obtained in Examples 9a and 9b and powdery alumina hydrates obtained in Examples 10a and 10b were mixed, respectively, so as to be a mixing ratio of 15:1 by weight (Comparative Examples 5 and 7), and powdery alumina hydrates obtained in Examples 9a and 9b and powdery alumina hydrates obtained in Examples 10a and 10b were mixed, respectively, so as to be a mixing ratio of 1:15 by weight (Comparative Examples 6 and 8), to prepare 4 dispersions having the same solid concentration of 15% by weight as Example 1. The homogenized dispersions were applied on PET films same as in Example 1 so as to obtain the same dry thickness as in Example 1, respectively. The PET films coated with the mixture were heated and dried at 100° C. for one hour in an oven to obtain a respective recording medium having an ink-receiving layer. Properties of the ink-receiving layer were measured as described above in the same manner as in Example 1. The test results are shown in Table 7.

Comparative Examples 9 to 11

A respective alumina sol was prepared in the same manner as in JP-A-5-32413, Example 1 and JP-A-5-32414, Examples 1 and 2. Thereto, a polyvinyl alcohol dispersion same as in Example 1 was added to the alumina sol mixtures in the same pigment/binder ratio as in Example 1, and the dispersion mixture was homogenized in the same manner as in Example 1. The homogenized dispersions were applied on a PET film same as in Example 1 so as to obtain the same dry thickness as in Example 1, respectively. Each the PET film coated with the mixture was heated and dried at 100° C. for one hour in an oven to obtain a recording medium having an ink-receiving layer. Properties of the ink-receiving layer were measured as described above in the same manner as in Example 1. The test results are shown in Table 8.

Comparative Examples 12 to 15

To an alumina sol (AS-3, produced by Shokubai Kasei K.K. (Catalysts & Chemicals Ind. Co., Ltd.)), an alumina sol (AS-2, produced by Shokubai Kasei K.K.), an alumina sol (AS-1, produced by Shokubai Kasei K.K.), or an alumina sol (520, produced by Nissan Chemical Industries, Ltd.) respectively having an alumina hydrate of pseudo-boehmite structure, a polyvinyl alcohol dispersion same as in Example 1 was added so as to become the same pigment/binder ratio as in Example 1, and the dispersion mixture was homogenized in the same manner as in Example 1. The homogenized dispersion was applied on a PET film same as in Example 1 so as to obtain the same dry thickness as in Example 1. The PET film coated with the mixture was heated and dried at 100° C. for one hour in an oven to obtain a recording medium having an ink-receiving layer. Properties of the ink-receiving layer were measured as described above in the same manner as in Example 1. The test results are shown in Table 8.

The present invention exhibits great advantages as follows.

1. The balance in quantity of hydrophobic and hydrophilic moieties on the alumina hydrate is optimized by controlling an interplanar spacing of (020) plane to be exceeding 0.617 nm but not more 0.620 nm. Thereby, dyes for the ink can be selected widely; an optical density of the printed area and the dot diameter are uniform; dye bleeding is prevented; and the color balance is improved regardless of employing either an ink containing a hydrophilic dye or a hydrophobic dye, or a combination of the inks.

In another embodiment of the present invention, by combining alumina hydrate having an interplanar spacing of (020) plane of not more than 0.617 nm and other one of not less than 0.620 nm, and further by controlling the balance of a hydrophilicity and a hydrophobicity more positively. Thereby, dyes for the ink can be selected widely.

2. By controlling a crystallite size of the alumina hydrate in the recording medium to be in the range of from 6.0 to 10.0 nm in a direction perpendicular to (010) plane of the alumina hydrate, there can be obtained a recording medium which has an excellent transparency, an excellent ink absorbency, and an excellent dye adsorption property, and does not cause cracking, curling, and tacking.
3. It has been found that the crystallite size in a direction perpendicular to (010) plane of the alumina hydrate in a recording medium becomes remarkably large at an interplanar spacing of (020) plane of 0.617 nm or smaller. The crystallite size in a direction perpendicular to the (010) plane can be controlled by adjusting an interplanar spacing of (020) plane to be larger than 0.617 nm. Therefore, both the desired an interplanar spacing of (020) plane and the desired crystallite size in a direction perpendicular to (010) plane can be optimized. Consequently, there can be obtained a recording medium satisfying requirements that an ink selectivity, an ink absorbency and a transparency of the recording medium are improved, and that cracking, powder-falling, curling, and tacking of the recording medium are prevented.
4. An ink absorbency and a print density can be further improved by optimizing the interplanar spacing of (020) plane and the crystallite size in a direction perpendicular to (010) plane, in addition to optimizing a pore radius distribution and a pore volume.

TABLE 1

| | Example No. | | | | | | | |
|---|---|---|---|---|---|---|---|---|
| | 1 | 2 | 3 | 4 | 5 | 6 | 7 | 8 |
| Aging: | | | | | | | | |
| pH before aging | 6.1 | 6.9 | 6.0 | 7.1 | 5.9 | 6.7 | 6.2 | 6.9 |
| Temperature (°C.) | 165 | 50 | 170 | 55 | 90 | 50 | 85 | 53 |
| Time | 4 hours | 10 days | 4 hours | 10 days | 4 hours | 6 days | 4 hours | 6 days |
| Apparatus | Auto-clave | Oven | Auto-clave | Oven | Auto-clave | Oven | Auto-clave | Oven |
| Titanium dioxide content (ICP, % by weight) | — | — | 0.150 | 0.150 | — | — | 0.150 | 0.150 |
| Titanium dioxide content (ESCA, % by weight) | — | — | 0.108 | 0.109 | — | — | 0.108 | 0.109 |
| After surface etching | | | | | | | | |
| for 100 seconds | — | — | 0.051 | 0.051 | — | — | 0.051 | 0.052 |
| for 500 seconds | — | — | 0.000 | 0.000 | — | — | 0.000 | 0.000 |
| Particle shape | Plate | Plate | Plate | Plate | Plate | Plate | Plate | Plate |
| Average particle radius (nm) | 33.0 | 35.0 | 29.0 | 32.0 | 32.0 | 34.0 | 31.0 | 32.5 |
| Aspect ratio | 6.5 | 8.3 | 5.5 | 8.1 | 6.3 | 7.4 | 6.0 | 7.7 |
| Transition temperature (°C.) | 180 | 180 | 180 | 180 | 180 | 180 | 180 | 180 |
| Interplanar spacing (nm) | 0.618 | 0.619 | 0.618 | 0.619 | 0.621 | 0.622 | 0.624 | 0.629 |
| Crystallite size (nm) | 8.0 | 7.0 | 7.5 | 6.5 | 4.5 | 3.7 | 3.2 | 2.9 |

TABLE 2

| | Example No. | | | | | | | |
|---|---|---|---|---|---|---|---|---|
| | 1 | 2 | 3 | 4 | 5 | 6 | 7 | 8 |
| Interplanar spacing (nm) | 0.618 | 0.619 | 0.618 | 0.619 | 0.618 | 0.619 | 0.618 | 0.619 |
| Crystallite size (nm) | 8.0 | 7.0 | 7.5 | 6.5 | 7.7 | 7.2 | 6.9 | 6.3 |
| BET specific surface area ($m^2/g$) | 210 | 160 | 200 | 170 | 230 | 180 | 220 | 190 |
| Average pore radius (nm) | 7.0 | 7.0 | 6.0 | 8.0 | 6.0 | 6.6 | 6.0 | 6.4 |
| Half width (nm) | 4.5 | 2.3 | 3.5 | 2.2 | 3.4 | 2.5 | 3.6 | 2.5 |
| Pore distribution | | | | | | | | |
| Peak 1 (nm) | 7.0 | 11.0 | 8.0 | 10.0 | 6.0 | 9.5 | 8.0 | 9.0 |
| Peak 2 (nm) | — | 4.0 | — | 3.5 | — | 3.0 | — | 2.5 |
| Pore volume | | | | | | | | |
| ($cm^3/g$) | 0.59 | 0.58 | 0.55 | 0.57 | 0.56 | 0.58 | 0.55 | 0.56 |
| ($cm^3/m^2$) | 9.0 | 8.6 | 9.0 | 8.4 | 9.0 | 8.8 | 9.0 | 8.6 |
| Volume ratio of Peak 2 (%) | — | 5 | — | 3 | — | 5 | — | 3 |
| Relative press. difference ($\Delta P$) | 0.03 | 0.04 | 0.04 | 0.03 | 0.03 | 0.04 | 0.04 | 0.03 |
| Haze | 4.5 | 4.0 | 4.3 | 4.5 | 4.4 | 4.2 | 4.7 | 4.3 |
| Resistance to Cracking | Good | Good | Good | Good | Good | Good | Good | Good |
| Resistance to Curling | Good | Good | Good | Good | Good | Good | Good | Good |
| Resistance to Tacking | Good | Good | Good | Good | Good | Good | Good | Good |
| Printing characteristics | | | | | | | | |
| Drying | Good | Good | Good | Good | Good | Good | Good | Good |
| Image density | | | | | | | | |
| Y | 1.75 | 1.75 | 1.73 | 1.77 | 1.72 | 1.73 | 1.77 | 1.76 |
| M | 1.70 | 1.73 | 1.75 | 1.75 | 1.76 | 1.75 | 1.75 | 1.74 |
| C | 1.75 | 1.77 | 1.71 | 1.73 | 1.74 | 1.74 | 1.73 | 1.74 |
| Bk | 1.80 | 1.75 | 1.73 | 1.73 | 1.73 | 1.76 | 1.71 | 1.76 |
| Resistance to Bleeding | Good | Good | Good | Good | Good | Good | Good | Good |
| Resistance to Beading | Good | Good | Good | Good | Good | Good | Good | Good |
| Resistance to Repulsion | Good | Good | Good | Good | Good | Good | Good | Good |
| Dot diameter (μm) | | | | | | | | |
| Y | 95 | 91 | 94 | 93 | 96 | 93 | 97 | 96 |
| M | 93 | 92 | 95 | 91 | 93 | 96 | 93 | 93 |
| C | 94 | 92 | 93 | 95 | 94 | 91 | 95 | 96 |
| Bk | 95 | 91 | 92 | 97 | 97 | 96 | 91 | 95 |

TABLE 3

| | Example No. | | | | | | | |
|---|---|---|---|---|---|---|---|---|
| | 9a | 9b | 10a | 10b | 11a | 11b | 12a | 12b |
| Aging: | | | | | | | | |
| pH before aging | 6.3 | 6.5 | 7.0 | 6.8 | 5.8 | 5.8 | 7.3 | 7.4 |
| Temperature (°C.) | 150 | 120 | 65 | 50 | 155 | 115 | 55 | 40 |
| Time | 5 hours | 6 hours | 10 days | 10 days | 4 hours | 5 hours | 12 days | 12 days |
| Apparatus | Auto-clave | Auto-clave | Oven | Oven | Auto-clave | Auto-clave | Oven | Oven |
| Drying temperature (°C.) | 180 | 80 | 180 | 80 | 180 | 80 | 180 | 80 |
| Titanium dioxide content (ICP, % by weight) | — | — | — | — | 0.150 | 0.150 | 0.150 | 0.150 |
| Titanium dioxide content (ESCA, % by weight) | — | — | — | — | 0.109 | 0.108 | 0.108 | 0.109 |
| After surface etching | | | | | | | | |
| for 100 seconds | — | — | — | — | 0.052 | 0.051 | 0.051 | 0.052 |
| for 500 seconds | — | — | — | — | 0.000 | 0.000 | 0.000 | 0.000 |
| Particle shape | Plate | Plate | Plate | Plate | Plate | Plate | Plate | Plate |
| Average particle radius (nm) | 29.0 | 27.0 | 28.0 | 28.0 | 29.0 | 27.0 | 29.0 | 29.0 |
| Aspect ratio | 7.5 | 6.8 | 5.9 | 7.1 | 7.3 | 6.5 | 5.6 | 7.2 |
| Transition temperature (°C.) | 180 | 180 | 180 | 180 | 180 | 180 | 180 | 180 |
| Interplanar spacing (nm) | 0.617 | 0.622 | 0.615 | 0.621 | 0.617 | 0.620 | 0.616 | 0.623 |
| Crystallite size (nm) | 13.0 | 3.5 | 15.0 | 4.0 | 13.3 | 4.5 | 14.0 | 3.0 |

TABLE 4

| | Example No. | | | |
|---|---|---|---|---|
| | 9 | 10 | 11 | 12 |
| Interplanar spacing (nm) | 0.619 | 0.618 | 0.619 | 0.620 |
| Crystallite size (nm) | 7.8 | 9.0 | 8.7 | 8.3 |
| BET specific surface area ($m^2/g$) | 205 | 165 | 205 | 175 |
| Average pore radius (nm) | 7.3 | 7.0 | 5.9 | 7.7 |
| Half width (nm) | 4.4 | 2.2 | 3.7 | 2.4 |
| Pore distribution | | | | |
| Peak 1 (nm) | 7.2 | 10.5 | 7.5 | 9.7 |
| Peak 2 (nm) | — | 3.5 | — | 2.3 |
| Pore volume | | | | |
| ($cm^3/g$) | 0.58 | 0.56 | 0.57 | 0.58 |
| ($cm^3/m^2$) | 9.0 | 8.5 | 8.8 | 8.6 |
| Volume ratio of Peak 2 (%) | — | 5 | — | 4 |
| Relative pressure difference (ΔP) | 0.03 | 0.04 | 0.04 | 0.03 |
| Haze | 4.9 | 4.3 | 4.4 | 4.1 |
| Resistance to Cracking | Good | Good | Good | Good |
| Resistance to Curling | Good | Good | Good | Good |
| Resistance to Tacking | Good | Good | Good | Good |

TABLE 4-continued

| | Example No. | | | |
|---|---|---|---|---|
| | 9 | 10 | 11 | 12 |
| Printing characteristics | | | | |
| Drying | Good | Good | Good | Good |
| Image density | | | | |
| Y | 1.76 | 1.73 | 1.79 | 1.75 |
| M | 1.73 | 1.75 | 1.74 | 1.77 |
| C | 1.77 | 1.74 | 1.76 | 1.79 |
| Bk | 1.81 | 1.75 | 1.74 | 1.74 |
| Resistance to Bleeding | Good | Good | Good | Good |
| Resistance to Beading | Good | Good | Good | Good |
| Resistance to Repulsion | Good | Good | Good | Good |
| Dot diameter (μm) | | | | |
| Y | 99 | 93 | 97 | 98 |
| M | 97 | 95 | 95 | 93 |
| C | 98 | 96 | 98 | 92 |
| Bk | 96 | 92 | 94 | 93 |

TABLE 5

| | Example No. | | | | | | | |
|---|---|---|---|---|---|---|---|---|
| | 13 | 14 | 15 | 16 | 17 | 18 | 19 | 20 |
| Interplanar spacing (nm) | 0.618 | 0.619 | 0.618 | 0.619 | 0.618 | 0.619 | 0.618 | 0.619 |
| Crystallite size (nm) | 8.0 | 7.0 | 7.5 | 6.5 | 7.7 | 7.2 | 6.9 | 6.3 |
| Resistance to Powder-falling | Good | Good | Good | Good | Good | Good | Good | Good |
| Resistance to Curling | Good | Good | Good | Good | Good | Good | Good | Good |
| Resistance to Tacking | Good | Good | Good | Good | Good | Good | Good | Good |
| Printing characteristics | | | | | | | | |
| Drying | Good | Good | Good | Good | Good | Good | Good | Good |
| Image density | | | | | | | | |
| Y | 1.16 | 1.13 | 1.19 | 1.15 | 1.11 | 1.14 | 1.15 | 1.17 |

TABLE 5-continued

| | Example No. | | | | | | | |
|---|---|---|---|---|---|---|---|---|
| | 13 | 14 | 15 | 16 | 17 | 18 | 19 | 20 |
| M | 1.13 | 1.15 | 1.14 | 1.17 | 1.11 | 1.18 | 1.19 | 1.13 |
| C | 1.17 | 1.14 | 1.16 | 1.19 | 1.12 | 1.12 | 1.14 | 1.12 |
| Bk | 1.18 | 1.15 | 1.14 | 1.14 | 1.15 | 1.15 | 1.16 | 1.15 |
| Resistance to Bleeding | Good | Good | Good | Good | Good | Good | Good | Good |
| Resistance to Beading | Good | Good | Good | Good | Good | 5 | Good | Good |
| Resistance to Repulsion | Good | Good | Good | Good | Good | Good | Good | Good |
| Dot diameter (μm) | | | | | | | | |
| Y | 109 | 103 | 107 | 108 | 102 | 106 | 108 | 104 |
| M | 107 | 105 | 105 | 103 | 105 | 103 | 102 | 107 |
| C | 108 | 106 | 108 | 102 | 107 | 102 | 103 | 105 |
| Bk | 106 | 102 | 104 | 103 | 103 | 101 | 105 | 102 |

TABLE 6

| | Example No. | | | |
|---|---|---|---|---|
| | 21 | 22 | 23 | 24 |
| Interplanar spacing (nm) | 0.619 | 0.618 | 0.619 | 0.620 |
| Crystallite size (nm) | 7.8 | 9.0 | 8.7 | 8.3 |
| Resistance to Powder-falling | Good | Good | Good | Good |
| Resistance to Curling | Good | Good | Good | Good |
| Resistance to Tacking | Good | Good | Good | Good |
| Printing characteristics | | | | |
| Drying | Good | Good | Good | Good |
| Image density | | | | |
| Y | 1.15 | 1.15 | 1.13 | 1.17 |
| M | 1.10 | 1.13 | 1.15 | 1.15 |
| C | 1.15 | 1.17 | 1.11 | 1.13 |

TABLE 6-continued

| | Example No. | | | |
|---|---|---|---|---|
| | 21 | 22 | 23 | 24 |
| Bk | 1.18 | 1.15 | 1.13 | 1.13 |
| Resistance to Bleeding | Good | Good | Good | Good |
| Resistance to Beading | Good | Good | Good | Good |
| Resistance to Repulsion | Good | Good | Good | Good |
| Dot diameter (μm) | | | | |
| Y | 105 | 101 | 104 | 103 |
| M | 103 | 102 | 105 | 101 |
| C | 104 | 102 | 103 | 105 |
| Bk | 105 | 101 | 102 | 107 |

TABLE 7

| | Comparative Example No. | | | | | | | |
|---|---|---|---|---|---|---|---|---|
| | 1 | 2 | 3 | 4 | 5 | 6 | 7 | 8 |
| Interplanar spacing (nm) | 0.624 | 0.617 | 0.622 | 0.615 | 0.616 | 0.623 | 0.616 | 0.621 |
| Crystallite size (nm) | 3.0 | 13.2 | 3.3 | 15.5 | 14.3 | 3.5 | 14.5 | 4.0 |
| BET specific surface area ($m^2/g$) | 215 | 215 | 161 | 161 | 229 | 228 | 183 | 181 |
| Average pore radius (nm) | 7.2 | 7.1 | 6.9 | 7.0 | 6.2 | 6.1 | 6.6 | 6.7 |
| Half width (nm) | 3.5 | 3.4 | 2.1 | 2.2 | 3.1 | 3.3 | 2.4 | 2.3 |
| Pore distribution | | | | | | | | |
| Peak 1 (nm) | 7.2 | 7.1 | 11.3 | 11.2 | 5.9 | 6.0 | 9.3 | 9.5 |
| Peak 2 (nm) | — | — | 3.2 | 3.1 | — | — | 2.5 | 3.0 |
| Pore volume | | | | | | | | |
| ($cm^3/g$) | 0.60 | 0.60 | 0.58 | 0.58 | 0.57 | 0.57 | 0.58 | 0.58 |
| ($cm^3/m^2$) | 8.9 | 8.8 | 8.6 | 8.6 | 8.9 | 8.9 | 8.8 | 8.8 |
| Volume ratio of Peak 2 (%) | — | — | 7 | 7 | — | — | 5 | 5 |
| Relative press. difference (ΔP) | 0.03 | 0.03 | 0.03 | 0.03 | 0.03 | 0.03 | 0.03 | 0.03 |
| Haze | 5.0 | 35.0 | 5.2 | 40.1 | 38.1 | 4.9 | 33.5 | 4.7 |
| Resistance to Cracking | Fair | Poor | Poor | Fair | Poor | Poor | Fair | Fair |
| Resistance to Curling | Poor | Poor | Poor | Poor | Poor | Poor | Poor | Poor |
| Resistance to Tacking | Poor | Good | Fair | Good | Good | Fair | Good | Poor |
| Printing characteristics | | | | | | | | |
| Drying | Fair | Good | Fair | Good | Good | Fair | Good | Fair |

TABLE 7-continued

| | Comparative Example No. | | | | | | | |
|---|---|---|---|---|---|---|---|---|
| | 1 | 2 | 3 | 4 | 5 | 6 | 7 | 8 |
| Image density | | | | | | | | |
| Y | 1.65 | 1.55 | 1.63 | 1.57 | 1.53 | 1.62 | 1.56 | 1.67 |
| M | 1.60 | 1.53 | 1.65 | 1.55 | 1.55 | 1.66 | 1.54 | 1.65 |
| C | 1.65 | 1.57 | 1.61 | 1.53 | 1.54 | 1.64 | 1.54 | 1.63 |
| Bk | 1.63 | 1.55 | 1.63 | 1.53 | 1.56 | 1.63 | 1.56 | 1.61 |
| Resistance to Bleeding | Poor | Good | Fair | Good | Good | Poor | Fair | Poor |
| Resistance to Beading | Poor | Good | Poor | Fair | Fair | Fair | Good | Poor |
| Resistance to Repulsion | Good | Poor | Good | Good | Good | Good | Good | Good |
| Dot diameter (μm) | | | | | | | | |
| Y | 95 | 107 | 94 | 103 | 109 | 96 | 106 | 97 |
| M | 93 | 102 | 95 | 101 | 106 | 93 | 103 | 93 |
| C | 87 | 98 | 85 | 97 | 98 | 84 | 99 | 87 |
| Bk | 95 | 101 | 92 | 107 | 106 | 97 | 105 | 91 |

TABLE 8

| | Comparative Example No. | | | | | | |
|---|---|---|---|---|---|---|---|
| | 9 | 10 | 11 | 12 | 13 | 14 | 15 |
| Interplanar spacing (nm) | 0.617 | 0.615 | 0.613 | 0.622 | 0.626 | 0.624 | 0.621 |
| Crystallite size (nm) | 10.5 | 13.5 | 14.7 | 5.3 | 4.3 | 4.6 | 5.5 |
| BET specific surface area ($m^2/g$) | 250 | 255 | 260 | 225 | 268 | 240 | 280 |
| Average pore radius (nm) | 7.0 | 7.0 | 5.5 | 2.0 | 1.6 | 1.8 | 1.5 |
| Half width (nm) | 1.0 | 1.0 | 1.0 | 0.7 | 0.5 | 0.7 | 0.5 |
| Pore distribution | | | | | | | |
| Peak 1 (nm) | 7.0 | 7.0 | 5.5 | 2.0 | 1.6 | 1.8 | 1.5 |
| Peak 2 (nm) | — | — | — | — | — | — | — |
| Pore volume | | | | | | | |
| ($cm^3/g$) | 0.67 | 0.69 | 0.68 | 0.60 | 0.37 | 0.35 | 0.21 |
| ($cm^3/m^2$) | 9.3 | 9.5 | 9.6 | 6.8 | 4.2 | 4.0 | 2.9 |
| Volume ratio of peak 2 (%) | — | — | — | — | — | — | — |
| Relative pressure difference (ΔP) | 0.25 | 0.23 | 0.21 | 0.22 | 0.25 | 0.24 | 0.28 |
| Haze | 30.0 | 35.0 | 40.0 | 5.0 | 6.3 | 5.2 | 5.4 |
| Resistance to Cracking | Poor | Poor | Poor | Poor | Poor | Poor | Poor |
| Resistance to Curling | Poor | Poor | Poor | Poor | Poor | Poor | Poor |
| Resistance to Tacking | Good | Good | Good | Fair | Fair | Fair | Fair |
| Printing characteristics | | | | | | | |
| Drying | Fair | Good | Fair | Good | Poor | Poor | Poor |
| Image density | | | | | | | |
| Y | 1.60 | 1.58 | 1.63 | 1.67 | 1.65 | 1.61 | 1.48 |
| M | 1.80 | 1.78 | 1.65 | 1.49 | 1.48 | 1.45 | 1.45 |
| C | 1.45 | 1.47 | 1.61 | 1.55 | 1.44 | 1.47 | 1.44 |
| Bk | 1.60 | 1.56 | 1.63 | 1.51 | 1.49 | 1.52 | 1.50 |
| Resistance to Bleeding | Good | Good | Good | Poor | Poor | Poor | Poor |
| Resistance to Bbeading | Good | Good | Good | Fair | Fair | Fair | Fair |
| Resistance to Repulsion | Poor | Poor | Poor | Good | Good | Good | Good |
| Dot diameter (μm) | | | | | | | |
| Y | 85 | 87 | 84 | 93 | 96 | 92 | 104 |
| M | 93 | 92 | 93 | 91 | 97 | 100 | 105 |
| C | 107 | 108 | 105 | 87 | 84 | 86 | 88 |
| Bk | 95 | 93 | 92 | 97 | 100 | 101 | 106 |

What is claimed is:

1. A recording medium containing alumina hydrate of a boehmite structure, in which an interplanar spacing of (020) plane of the alumina hydrate exceeds 0.617 nm but not more than 0.620 nm, and the crystallite size in a direction perpendicular to (010) plane ranges from 6.0 to 10.0 nm, wherein the alumina hydrate is contained in an ink-receiving layer provided on a base material, or is incorporated in a fibrous substrate.

2. The recording medium containing alumina hydrate of a boehmite structure according to claim 1, wherein the alumina hydrate comprises at least one kind of alumina hydrate having a boehmite structure having an interplanar spacing of (020) plane of not more than 0.617 nm and at least one other kind of alumina hydrate of a boehmite structure having an interplanar spacing of (020) plane of not less than 0.620 nm, and having, as a whole, an interplanar spacing of (020) plane exceeding 0.617 nm but not more than 0.620 nm, and crystallite size in a direction perpendicular to (010) plane direction ranging from 6.0 to 10.0 nm.

3. The recording medium according to claim 2, wherein the alumina hydrate having an interplanar spacing of (020) plane of not more than 0.617 nm and the alumina hydrate having an interplanar spacing of (020) plane of not less than 0.620 nm are mixed in a ratio ranging from 10:1 to 1:10 by weight.

4. The recording medium according to claim 3, wherein the alumina hydrate having an interplanar spacing of (020) plane of not more than 0.617 nm and the alumina hydrate having an interplanar spacing of (020) plane of not less than 0.620 nm are mixed in a ratio ranging from 5:1 to 1:5 by weight.

5. The recording medium according to claim 1, wherein the ink-receiving layer contains a binder.

6. The recording medium according to claim 5, wherein the alumina hydrate and the binder is mixed in a ratio ranging from 5:1 to 20:1 by weight.

7. The recording medium according to claim 6, wherein the alumina hydrate and the binder is mixed in a ratio ranging from 7:1 to 15:1 by weight.

8. The recording medium according to claim 1, wherein the alumina hydrate contains titanium dioxide.

9. The recording medium according to claim 8, wherein a content of titanium dioxide ranges from 0.01% to 1.00% by weight based on the weight of the alumina hydrate.

10. The recording medium according to claim 1, wherein the alumina hydrate has an aspect ratio ranging from 3 to 10.

11. The recording medium according to claim 1, wherein the alumina hydrate has an average particle diameter or an average particle length ranging from 1 to 50 nm.

12. The recording medium according to claim 1, wherein the ink-receiving layer has a BET specific surface area ranging from 70 $m^2/g$ to 300 $m^2/g$.

13. The recording medium according to claim 1, wherein the ink-receiving layer has an average pore radius ranging from 2.0 nm to 20.0 nm and a half width of a pore radius distribution ranging from 2.0 nm to 15.0 nm.

14. The recording medium according to claim 1, wherein the ink-receiving layer has pores having two or more peaks in pore radius distribution.

15. The recording medium according to claim 14, wherein one of the peaks is in a range of not more than 10.0 nm, and another one of the peaks is in a range of from 10.0 to 20.0 nm of the pore radius, respectively.

16. The recording medium according to claim 1, wherein the ink-receiving layer has a pore volume ranging from 0.4 $m^3/g$ to 0.6 $cm^3/g$.

17. The recording medium according to claim 1, wherein the ink-receiving layer has a pore volume of not less than 8 $cm^3/m^2$.

18. The recording medium according to claim 1, wherein a relative pressure difference between adsorption and desorption at 90% of the maximum amount of adsorbed gas found from an isothermal nitrogen adsorption-desorption curve for the ink-receiving layer is not more than 0.2.

19. A printed recording medium comprising an image formed on the recording medium of claim 1.

20. The recording medium according to claim 1, wherein the alumina hydrate is represented by the formula $$Al_2O_{3-n}(OH)_{2n}.mH_2O$$

wherein n is an integer of 0 to 3, m is a number of from 0 to 10 and m and n are not both 0.

* * * * *

UNITED STATES PATENT AND TRADEMARK OFFICE

CERTIFICATE OF CORRECTION

PATENT NO. : 5,707,716

DATED : January 13, 1998

INVENTOR(S) : HITOSHI YOSHINO, ET AL.

It is certified that error appears in the above-identified patent and that said Letters Patent is hereby corrected as shown below:

COLUMN 34:

Line 14, "$m^3/g$" should read --$cm^3/g$--.

Signed and Sealed this

Twenty-third Day of June, 1998

*Attest:*

BRUCE LEHMAN

*Attesting Officer*

*Commissioner of Patents and Trademarks*